US010824107B2

(12) United States Patent
Kadota et al.

(10) Patent No.: US 10,824,107 B2
(45) Date of Patent: Nov. 3, 2020

(54) IMAGE FORMING APPARATUS AND METHOD FOR CONTROLLING IMAGE FORMING APPARATUS

(71) Applicant: KYOCERA Document Solutions Inc., Osaka (JP)

(72) Inventors: Masaki Kadota, Osaka (JP); Yosuke Saito, Osaka (JP); Kazuaki Fujiwara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/692,782

(22) Filed: Nov. 22, 2019

(65) Prior Publication Data

US 2020/0166884 A1 May 28, 2020

(30) Foreign Application Priority Data

Nov. 26, 2018 (JP) ..... 2018-220549
Nov. 26, 2018 (JP) ..... 2018-220552

(51) Int. Cl.

| | |
|---|---|
| ***G03G 15/20*** | (2006.01) |
| ***G03G 21/00*** | (2006.01) |
| ***G03G 15/00*** | (2006.01) |
| ***G03G 21/20*** | (2006.01) |

(52) U.S. Cl.
CPC ..... *G03G 15/80* (2013.01); *G03G 15/2039* (2013.01); *G03G 21/203* (2013.01)

(58) Field of Classification Search
CPC .. G03G 15/80; G03G 15/2039; G03G 15/205; G03G 21/20; G03G 21/203
See application file for complete search history.

(56) References Cited

U.S. PATENT DOCUMENTS

2005/0007628 A1 1/2005 Yamano et al. ..... 358/1.15
2006/0250634 A1* 11/2006 Nishiyama ..... G03G 15/2039 358/1.14
2015/0110508 A1* 4/2015 Nishi ..... G03G 21/203 399/44
2016/0252852 A1 9/2016 Nakachi
2017/0068204 A1* 3/2017 Koizumi ..... G03G 15/80

FOREIGN PATENT DOCUMENTS

JP 2004-020591 A 1/2004
JP 2015-230459 A 12/2015
JP 6274133 B2 1/2018

OTHER PUBLICATIONS

Extended European Search Report dated Apr. 28, 2020, issued to corresponding European Application No. 19210506.2.

* cited by examiner

*Primary Examiner* — Sophia S Chen
(74) *Attorney, Agent, or Firm* — Stein IP, LLC

(57) ABSTRACT

A first supply mode is a mode for supplying power so that printing can be performed by a printing unit, and more power is supplied in the first supply mode than in the second supply mode or the third supply mode. More power is supplied in the second supply mode than in the third supply mode. In the specified period, the power supply circuit switches from the power supply in the first supply mode to the power supply in the second supply mode when a first transition condition is satisfied. The power supply circuit maintains the second supply mode without performing switching from the power supply in the second supply mode to the power supply in the third supply mode.

17 Claims, 11 Drawing Sheets

FIG.5

○ = ON (SUPPLY)
× = OFF(NOT SUPPLY)
△ = MINIMUM POWER SUPPLY TO LED ETC. THAT CAN RECOGNIZE SECOND SUPPLY MODE

| | | FIRST SUPPLY MODE (Active Mode) | SECOND SUPPLY MODE (Power Saving Mode) | THIRD SUPPLY MODE (Deep Sleep Mode) |
|---|---|---|---|---|
| POWER SUPPLY CIRCUIT | FIRST BLOCK | ○ | ○ | ○ |
| | SECOND BLOCK | ○ | ○ | × |
| MAIN CONTROLLER | MAIN BLOCK | ○ | ○ | × |
| | COMMUNICATION INTERFACE | ○ | ○ | ○ |
| STORAGE MEDIUM | | ○ | ○ | × |
| DOCUMENT FEEDER | | ○ | × | × |
| SCANNER | | ○ | × | × |
| ENGINE CONTROLLER | | ○ | ○ | × |
| PRINTING UNIT | | ○ | × | × |
| IH CONTROLLER | | ○ | × | × |
| IH UNIT | | ○ | × | × |
| TOUCH PANEL | | ○ | ○ | ○ |
| HARDWARE KEY | | ○ | ○ | ○ |
| DISPLAY PANEL | | ○ | △ | × |

FIG.10

D3

| TEMPERATURE (°C) | RELATIVE HUMIDITY (%RH) | | | | | | | | | | | | | | | | | | | |
|---|---|---|---|---|---|---|---|---|---|---|---|---|---|---|---|---|---|---|---|---|
| | 5 | 10 | 15 | 20 | 25 | 30 | 35 | 40 | 45 | 50 | 55 | 60 | 65 | 70 | 75 | 80 | 85 | 90 | 95 | 100 |
| 0 | 0.24 | 0.49 | 0.73 | 0.97 | 1.21 | 1.46 | 1.70 | 1.94 | 2.18 | 2.43 | 2.67 | 2.91 | 3.16 | 3.40 | 3.64 | 3.88 | 4.13 | 4.37 | 4.61 | 4.85 |
| 1 | 0.26 | 0.52 | 0.78 | 1.04 | 1.30 | 1.56 | 1.82 | 2.08 | 2.34 | 2.60 | 2.86 | 3.12 | 3.38 | 3.64 | 3.90 | 4.16 | 4.42 | 4.68 | 4.94 | 5.20 |
| 2 | 0.28 | 0.56 | 0.84 | 1.11 | 1.39 | 1.67 | 1.95 | 2.23 | 2.51 | 2.78 | 3.06 | 3.34 | 3.62 | 3.90 | 4.18 | 4.45 | 4.73 | 5.01 | 5.29 | 5.57 |
| 3 | 0.30 | 0.60 | 0.89 | 1.19 | 1.49 | 1.79 | 2.08 | 2.38 | 2.68 | 2.98 | 3.28 | 3.57 | 3.87 | 4.17 | 4.47 | 4.77 | 5.06 | 5.36 | 5.66 | 5.96 |
| 4 | 0.32 | 0.64 | 0.96 | 1.27 | 1.59 | 1.91 | 2.23 | 2.55 | 2.87 | 3.19 | 3.50 | 3.82 | 4.14 | 4.46 | 4.78 | 5.10 | 5.41 | 5.73 | 6.05 | 6.37 |
| 5 | 0.34 | 0.68 | 1.02 | 1.36 | 1.70 | 2.04 | 2.38 | 2.72 | 3.06 | 3.40 | 3.74 | 4.08 | 4.42 | 4.77 | 5.11 | 5.45 | 5.79 | 6.13 | 6.47 | 6.81 |
| 6 | 0.36 | 0.73 | 1.09 | 1.45 | 1.82 | 2.18 | 2.55 | 2.91 | 3.27 | 3.64 | 4.00 | 4.36 | 4.73 | 5.09 | 5.45 | 5.82 | 6.18 | 6.54 | 6.91 | 7.27 |
| 7 | 0.39 | 0.78 | 1.16 | 1.55 | 1.94 | 2.33 | 2.72 | 3.11 | 3.49 | 3.88 | 4.27 | 4.66 | 5.05 | 5.43 | 5.82 | 6.21 | 6.60 | 6.99 | 7.37 | 7.76 |
| 8 | 0.41 | 0.83 | 1.24 | 1.66 | 2.07 | 2.48 | 2.90 | 3.31 | 3.73 | 4.14 | 4.56 | 4.97 | 5.38 | 5.80 | 6.21 | 6.63 | 7.04 | 7.45 | 7.87 | 8.28 |
| 9 | 0.44 | 0.88 | 1.32 | 1.77 | 2.21 | 2.65 | 3.09 | 3.53 | 3.97 | 4.42 | 4.86 | 5.30 | 5.74 | 6.18 | 6.62 | 7.06 | 7.51 | 7.95 | 8.39 | 8.83 |
| 10 | 0.47 | 0.94 | 1.41 | 1.88 | 2.35 | 2.82 | 3.29 | 3.77 | 4.24 | 4.71 | 5.18 | 5.65 | 6.12 | 6.59 | 7.06 | 7.53 | 8.00 | 8.47 | 8.94 | 9.41 |
| 11 | 0.50 | 1.00 | 1.50 | 2.01 | 2.51 | 3.01 | 3.51 | 4.01 | 4.51 | 5.01 | 5.52 | 6.02 | 6.52 | 7.02 | 7.52 | 8.02 | 8.52 | 9.03 | 9.53 | 10.03 |
| 12 | 0.53 | 1.07 | 1.60 | 2.14 | 2.67 | 3.20 | 3.74 | 4.27 | 4.80 | 5.34 | 5.87 | 6.41 | 6.94 | 7.47 | 8.01 | 8.54 | 9.08 | 9.61 | 10.14 | 10.68 |
| 13 | 0.57 | 1.14 | 1.70 | 2.27 | 2.84 | 3.41 | 3.98 | 4.54 | 5.11 | 5.68 | 6.25 | 6.82 | 7.39 | 7.95 | 8.52 | 9.09 | 9.66 | 10.23 | 10.79 | 11.36 |
| 14 | 0.60 | 1.21 | 1.81 | 2.42 | 3.02 | 3.63 | 4.23 | 4.83 | 5.44 | 6.04 | 6.65 | 7.25 | 7.85 | 8.46 | 9.06 | 9.67 | 10.27 | 10.88 | 11.48 | 12.08 |
| 15 | 0.64 | 1.28 | 1.93 | 2.57 | 3.21 | 3.85 | 4.50 | 5.14 | 5.78 | 6.42 | 7.07 | 7.71 | 8.35 | 8.99 | 9.63 | 10.28 | 10.92 | 11.56 | 12.20 | 12.85 |
| 21 | 0.92 | 1.84 | 2.75 | 3.67 | 4.59 | 5.51 | 6.42 | 7.34 | 8.26 | 9.18 | 10.09 | 11.01 | 11.93 | 12.85 | 13.76 | 14.68 | 15.60 | 16.52 | 17.43 | 18.35 |
| 22 | 0.97 | 1.94 | 2.92 | 3.89 | 4.86 | 5.83 | 6.81 | 7.78 | 8.75 | 9.72 | 10.69 | 11.67 | 12.64 | 13.61 | 14.58 | 15.56 | 16.53 | 17.50 | 18.47 | 19.44 |
| 23 | 1.03 | 2.06 | 3.09 | 4.12 | 5.15 | 6.18 | 7.21 | 8.24 | 9.27 | 10.30 | 11.33 | 12.36 | 13.38 | 14.41 | 15.44 | 16.47 | 17.50 | 18.53 | 19.56 | 20.59 |
| 24 | 1.09 | 2.18 | 3.27 | 4.36 | 5.45 | 6.54 | 7.63 | 8.72 | 9.81 | 10.90 | 11.99 | 13.08 | 14.17 | 15.26 | 16.35 | 17.44 | 18.53 | 19.62 | 20.71 | 21.80 |
| 25 | 1.15 | 2.31 | 3.46 | 4.61 | 5.77 | 6.92 | 8.07 | 9.22 | 10.38 | 11.53 | 12.68 | 13.84 | 14.99 | 16.14 | 17.30 | 18.45 | 19.60 | 20.76 | 21.91 | 23.06 |
| 26 | 1.22 | 2.44 | 3.66 | 4.88 | 6.10 | 7.32 | 8.54 | 9.76 | 10.98 | 12.20 | 13.41 | 14.63 | 15.85 | 17.07 | 18.29 | 19.51 | 20.73 | 21.95 | 23.17 | 24.39 |
| 27 | 1.29 | 2.58 | 3.87 | 5.16 | 6.45 | 7.73 | 9.02 | 10.31 | 11.60 | 12.89 | 14.18 | 15.47 | 16.76 | 18.05 | 19.34 | 20.63 | 21.92 | 23.20 | 24.49 | 25.78 |
| 28 | 1.36 | 2.72 | 4.09 | 5.45 | 6.81 | 8.17 | 9.54 | 10.90 | 12.26 | 13.62 | 14.98 | 16.34 | 17.71 | 19.07 | 20.43 | 21.80 | 23.16 | 24.52 | 25.88 | 27.24 |
| 29 | 1.44 | 2.88 | 4.32 | 5.76 | 7.20 | 8.64 | 10.08 | 11.52 | 12.96 | 14.39 | 15.83 | 17.27 | 18.70 | 20.14 | 21.58 | 23.02 | 24.46 | 25.90 | 27.34 | 28.78 |
| 30 | 1.52 | 3.04 | 4.56 | 6.08 | 7.60 | 9.11 | 10.63 | 12.15 | 13.67 | 15.19 | 16.71 | 18.23 | 19.75 | 21.27 | 22.79 | 24.30 | 25.82 | 27.34 | 28.86 | 30.38 |

IMAGE FORMING APPARATUS AND METHOD FOR CONTROLLING IMAGE FORMING APPARATUS

INCORPORATION BY REFERENCE

This application is based upon and claims the benefit of priority from the corresponding Japanese Patent Application Nos. 2018-220552 and 2018-220549 filed Nov. 26, 2018, the entire contents of which are hereby incorporated by reference.

BACKGROUND

The present disclosure relates to an image forming apparatus that performs printing using toner and has a mode in which power consumption during standby is reduced.

There are image forming apparatuses that perform printing using toner. These image forming apparatuses include, for example, a multifunction peripheral, a copier, a printer, and a facsimile apparatus. The image forming apparatus that uses toner is provided with a photosensitive drum. When condensation occurs on the photosensitive drum, water drops (moisture) adhered to the photosensitive drum may prevent a toner image from being appropriately formed (image deletion). Therefore, a heater for the photosensitive drum may be disposed. The following image forming apparatus is known, which is provided with a heater for the photosensitive drum.

Specifically, there is an image forming apparatus, including an image forming unit having a photosensitive body so as to develop an electrostatic latent image formed on the photosensitive body on the basis of image data into a toner image and to transfer the toner image onto a paper sheet for image formation, a fixing unit having a fixing heater and disposed at a position capable of heating the photosensitive body by a fixing roller with the fixing heater as a heat source on a downstream side of the photosensitive body in a conveying direction of the paper sheet so as to heat and fix the toner image onto paper sheet, a dehumidification heater for heating the photosensitive body, a fixing heater drive unit for switching on/off of the fixing heater, a warm keeping heater drive unit for switching on/off of a warm keeping heater, and a controller that controls the fixing heater drive unit to turn off the fixing heater at a time point when a predetermined first period elapses from end of an image formation operating mode in which the image forming unit performs image forming operation in a state where the warm keeping heater is turned off by the warm keeping heater drive unit while the fixing heater is on/off controlled by the fixing heater drive unit so that the fixing roller is heated, and controls the warm keeping heater drive unit to turn on the warm keeping heater at timing when a predetermined second period longer than the first period elapses from end of the image formation operating mode. More energy saving can be achieved than conventional method, and condensation on the surface of the photosensitive drum can be suppressed with low cost.

During wintertime, when business hours are over, room heating is turned off. For instance, the room heating is turned off during night. When the room heating is turned off, room temperature is decreased. Along with the decrease of the room temperature, temperature inside the image forming apparatus is decreased. For instance, the temperature decrease during winter is sharp particularly in a prefab hut built at a construction site. Further, when business hours start (in next morning, for example), the room heating is turned on. The room heating heats the air in the room. When the heated air enters in the apparatus and contacts with the cooled photosensitive drum, condensation may occur on the photosensitive drum. In this way, condensation may occur on the photosensitive drum due to a large variation in the room temperature (temperature difference) during winter.

When moisture is adhered onto the photosensitive drum, an image may not be appropriately formed. It is because the moisture disturbs an electrical latent image formed on a surface of the photosensitive drum, for example. For instance, a blurred image is formed (image deletion). Therefore, a heater for the photosensitive drum may be disposed so that condensation does not occur on the photosensitive drum. However, the heater for the photosensitive drum is disposed in consideration of high temperature and high humidity environment in general. Accordingly, the heater for the photosensitive drum has a small power output (wattage). For instance, the heater for the photosensitive drum has a power output of approximately one to a few watts.

For instance, in an environment such as a winter construction site (a prefab hut), room temperature during night may be decreased down to 5° C. or lower. The room heating may increase the room temperature up to 20-25° C. When the temperature difference is large, the heater for the photosensitive drum cannot sufficiently warm the photosensitive drum to an extent that prevents condensation. There is a problem that even when the heater for the photosensitive drum is disposed, it may not be able to prevent condensation on the photosensitive drum under environment with a large temperature drop during night (environment with a large variation in room temperature due to on/off of room heating).

Note that the known technique described above can achieve energy saving. However, it may not be able to sufficiently prevent condensation on the photosensitive drum in an environment where room temperature varies largely due to on/off of room heating.

SUMMARY

An image forming apparatus according to the present disclosure includes a photosensitive drum, a heating rotating body, a heater, a controller, and a power supply circuit. The photosensitive drum forms a toner image. Further, the heating rotating body heats a paper sheet with the toner image transferred. The heater heats the heating rotating body. The controller includes a control circuit. The power supply circuit turns on and off power supply to the heater and the controller. The power supply circuit supplies power in one of a first supply mode, a second supply mode, and a third supply mode. The first supply mode is a mode for supplying power so that printing can be performed, and more power is supplied in the first supply mode than in the second supply mode or the third supply mode. More power is supplied in the second supply mode than in the third supply mode. In a period other than a predetermined specified period, the power supply circuit switches from the power supply in the first supply mode to the power supply in the second supply mode when a predetermined first transition condition is satisfied. When a predetermined second transition condition is satisfied, the power supply circuit switches from the power supply in the second supply mode to the power supply in the third supply mode. In the specified period, when the first transition condition is satisfied, the power supply circuit switches power supply in the first supply mode to the power supply in the second supply mode. The power supply circuit maintains the second supply mode without performing the switching from the power supply in the second supply mode to the power supply in the third supply mode.

An image forming apparatus according to another aspect of the present disclosure includes a photosensitive drum, a heating rotating body, a heater, a controller, a power supply circuit, an inside temperature sensor, an outside temperature sensor, an outside humidity sensor, and a storage medium. The photosensitive drum forms a toner image. The heating rotating body heats a paper sheet with the toner image transferred. The heater heats the heating rotating body. The controller includes a control circuit. The power supply circuit turns on and off power supply to the heater and the controller. The inside temperature sensor detects inside temperature. The outside temperature sensor detects outside temperature. The outside humidity sensor detects outside humidity. The power supply circuit supplies power in one of a first supply mode, a second supply mode, and a third supply mode. The first supply mode is a mode for supplying power so that printing can be performed, and more power is supplied in the first supply mode than in the second supply mode or the third supply mode. More power is supplied in the second supply mode than in the third supply mode. The controller recognizes the inside temperature on the basis of an output of the inside temperature sensor. The controller recognizes the outside temperature on the basis of an output of the outside temperature sensor. The controller recognizes the outside humidity on the basis of an output of the outside humidity sensor. The controller determines whether being in a condensation environment or not on the basis of the recognized inside temperature, outside temperature, and outside humidity. When determining being in the condensation environment, the controller controls the storage medium to store condensation environment data indicating being in the condensation environment in a nonvolatile manner. In case the condensation environment data is stored in the storage medium, the power supply circuit switches from the power supply in the first supply mode to the power supply in the second supply mode when a predetermined first transition condition is satisfied. When a predetermined second transition condition is satisfied, the power supply circuit switches from the power supply in the second supply mode to the power supply in the third supply mode. In case the condensation environment data is stored in the storage medium, the power supply circuit switches from the power supply in the first supply mode to the power supply in the second supply mode when the first transition condition is satisfied. The power supply circuit maintains the second supply mode without performing the switching from the power supply in the second supply mode to the power supply in the third supply mode.

A method for controlling an image forming apparatus according to the present disclosure includes forming a toner image using a photosensitive drum, heating a paper sheet with the toner image transferred using a heating rotating body, heating the heating rotating body using a heater, configuring the controller to include a control circuit, turning on and off of power supply to the heater and the controller, supplying power in one of a first supply mode, a second supply mode, and a third supply mode, configuring the first supply mode as a mode for supplying power so that printing can be performed, and that more power is supplied in the first supply mode than in the second supply mode or the third supply mode, configuring so that more power is supplied in the second supply mode than in the third supply mode, and in a period other than a predetermined specified period, in a period other than a predetermined specified period, switching from the power supply in the first supply mode to the power supply in the second supply mode when a predetermined first transition condition is satisfied, while switching from the power supply in the second supply mode to the power supply in the third supply mode when a predetermined second transition condition is satisfied, and in the specified period, switching from the power supply in the first supply mode to the power supply in the second supply mode when the first transition condition is satisfied, and maintaining the second supply mode without performing the switching from the power supply in the second supply mode to the power supply in the third supply mode.

Other characteristics and advantages of the present disclosure will become more apparent from the description of the embodiment given below.

BRIEF DESCRIPTION OF THE DRAWINGS

FIG. 5 is a diagram illustrating one example of supply modes of the power supply circuit according to the embodiment.

FIG. 10 is a diagram illustrating one example of an absolute humidity table according to the embodiment.

DETAILED DESCRIPTION

In the present disclosure, condensation on a rotating body for toner image formation (a photosensitive drum 61) is prevented also in an environment where room temperature varies largely due to on/off of room heating. With reference to FIGS. 1 to 11, an embodiment of the present disclosure is described below. In the following description, a multifunction peripheral 100 that performs printing using toner is exemplified and described as an image forming apparatus. However, elements such as structures and arrangements described in this embodiment are merely examples for description and do not limit the scope of the disclosure.

(Outline of Multifunction Peripheral 100)

Figure 1:
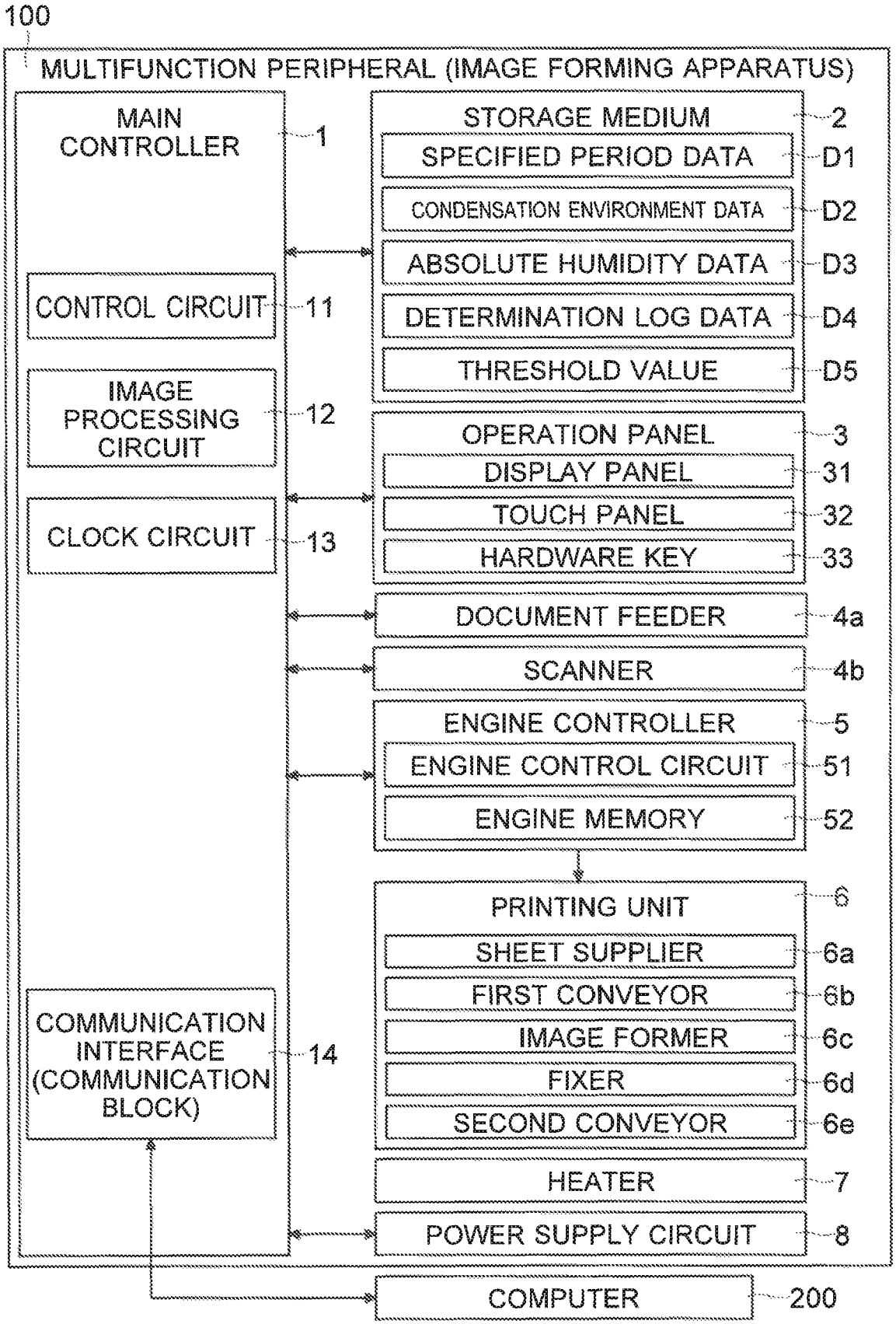
FIG. 1 is a diagram illustrating one example of a multifunction peripheral according to an embodiment.
Figure 2:
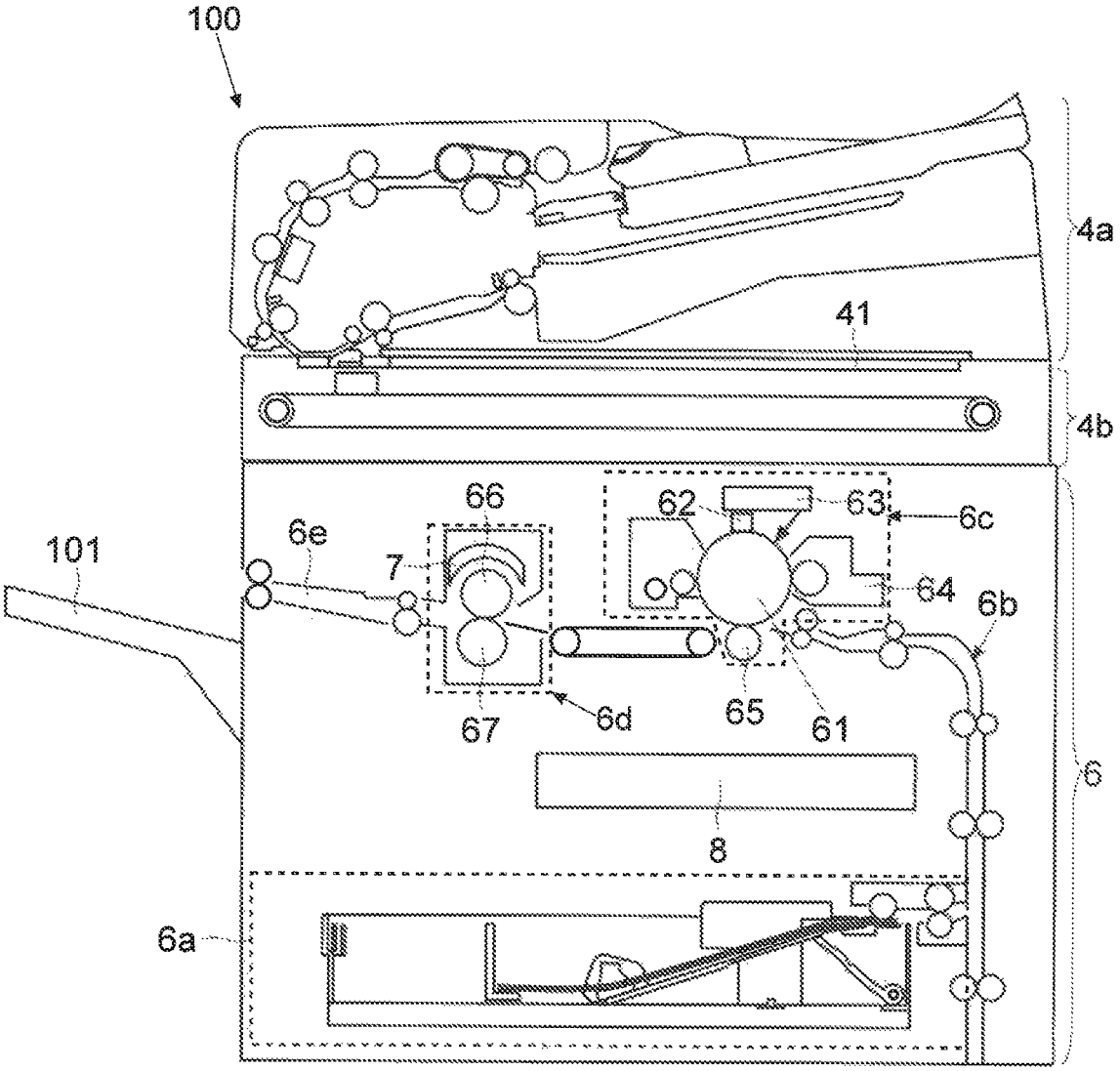
FIG. 2 is a diagram illustrating one example of the multifunction peripheral according to the embodiment.

First, with reference to FIGS. 1 and 2, the multifunction peripheral 100 according to the embodiment is described. The multifunction peripheral 100 includes a main controller 1 (controller circuit board). The main controller 1 controls operations of structural components of the multifunction peripheral 100 (a storage medium 2, an operation panel 3, a document feeder device 4*a*, a scanner 4*b*, an engine controller 5, a printing unit 6, a heater 7, and a power supply circuit 8). The main controller 1 includes a control circuit 11, an image processing circuit 12, a clock circuit 13, and a communication interface 14.

The control circuit 11 is a CPU, for example. The control circuit 11 is an integrated circuit that performs processing and calculation related to control of the multifunction peripheral 100. The image processing circuit 12 performs image processing on image data, which is necessary for printing. The communication interface 14 is a block in which communication circuits are integrated (a communication block). The communication interface 14 includes hardware such as a communication chip, a memory, and a connector. The communication interface 14 communicates with a computer 200. The computer 200 is a PC or a server, for example. The communication interface 14 receives print data from the computer 200. The print data includes data written in a page description language, image data, and print setting data. The main controller 1 controls the printing unit 6 to perform printing based on the print data.

Note that in the following description, a pert of the main controller 1 other than the communication interface 14 (the control circuit 11 and the image processing circuit 12) is referred to as a main block 10 (see FIG. 4). The main block 10 includes the control circuit 11, the image processing circuit 12, and an interface circuit for communication with the storage medium 2, the operation panel 3, the document feeder device 4*a*, the scanner 4*b*, the engine controller 5, the printing unit 6, the heater 7, and the power supply circuit 8.

The multifunction peripheral 100 includes a nonvolatile storage device such as a ROM and a HDD, and a volatile storage device such as a RAM, as the storage medium 2. The storage medium 2 stores control programs and data.

The operation panel 3 includes a display panel 31, a touch panel 32, and hardware keys 33. The display panel 31 displays a setting screen and a setting image. The setting image is, for example, a button or a tab. The touch panel 32 is attached to the display panel 31. The touch panel 32 detects coordinates of a position touched by a user. On the basis of the touch position recognized by the touch panel 32, the main controller 1 (main block 10) recognizes the setting image operated by the user. In addition, the operation panel 3 is provided with the hardware keys 33, too. For instance, the hardware keys 33 include a start key for instruction to execute a job. The main controller 1 (main block 10) recognizes the operated hardware key 33.

The multifunction peripheral 100 includes the document feeder device 4*a* and the scanner 4*b*. The document feeder device 4*a* feeds a set document sheet to a reading position. The scanner 4*b* reads the document sheet fed by the document feeder device 4*a* or a document placed on a document table 41, so as to generate image data. The main controller 1 (main block 10) controls operations of the document feeder device 4*a* and the scanner 4*b*.

The multifunction peripheral 100 includes the printing unit 6. The printing unit 6 includes a sheet supplier 6*a*, a first conveyor 6*b*, an image former 6*c*, a fixer 6*d*, and a second conveyor 6*e*. The engine controller 5 includes an engine control circuit 51 (engine CPU) and an engine memory 52. The main controller 1 and the engine controller 5 communicate with each other. The main controller 1 (main block 10) transmits a print instruction, content of print job, and image data to be used for printing to the engine controller 5. When receiving the instruction from the main controller 1, the engine controller 5 controls sheet supply, sheet conveyance, toner image formation, transferring, and fixing. Specifically, the engine controller 5 controls operations of the sheet supplier 6*a*, the first conveyor 6*b*, the image former 6*c*, the fixer 6*d*, the second conveyor 6*e*, and the heater 7.

The engine controller 5 controls the sheet supplier 6*a* to supply paper sheets one by one. The engine controller 5 controls the first conveyor 6*b* and the second conveyor 6*e* to convey the supplied paper sheet via the image former 6*c* and the fixer 6*d* to a discharge tray 101. The engine controller 5 controls the image former 6*c* to form a toner image to be transferred onto the conveyed paper sheet. The engine controller 5 controls to transfer the toner image onto the paper sheet. The engine controller 5 controls the fixer 6*d* to fix the transferred toner image to the paper sheet. The second conveyor 6*e* discharges the paper sheet with the fixed toner image onto the discharge tray 101.

As Illustrated in FIG. 2, the image former 6*c* includes the photosensitive drum 61, a charging device 62, an exposure device 63, a development device 64, and a transfer roller 65 (transfer device). The photosensitive drum 61 includes an amorphous silicon photosensitive body (photosensitive layer), for example. The photosensitive drum 61 has a photosensitive layer made of amorphous silicon on its circumferential surface. The photosensitive drum 61 carries a toner image.

The paper sheet enters a nip between the photosensitive drum 61 and the transfer roller 65. When performing printing, the engine controller 5 controls the photosensitive drum 61 and the transfer roller 65 to rotate. The engine controller 5 controls the charging device 62 to charge the photosensitive drum 61. The engine controller 5 controls the exposure device 63 to scan and expose the photosensitive drum 61. In this way, an electrostatic latent image corresponding to the image data is formed on the photosensitive drum 61. The engine controller 5 controls the development device 64 to develop the electrostatic latent image with toner (toner image formation). The engine controller 5 controls the transfer roller 65 to transfer the toner image onto the conveyed paper sheet. The engine controller 5 controls to convey the paper sheet to the image former 6*c* and controls the image former 6*c* to transfer the toner image onto the paper sheet.

As Illustrated in FIG. 2, the fixer 6*d* includes a heating rotating body 66 and a pressing rotating body 67. The paper sheet passes through a nip between the heating rotating body 66 and the pressing rotating body 67. The heater 7 is provided for the heating rotating body 66. For instance, the heater 7 is disposed above the heating rotating body 66. The heater 7 heats the heating rotating body 66 by induction heating (IH). The heating rotating body 66 heats the paper sheet with the transferred toner image. In this way, the toner image is fixed to the paper sheet.

(Power Supply Circuit 8)

Figure 3:
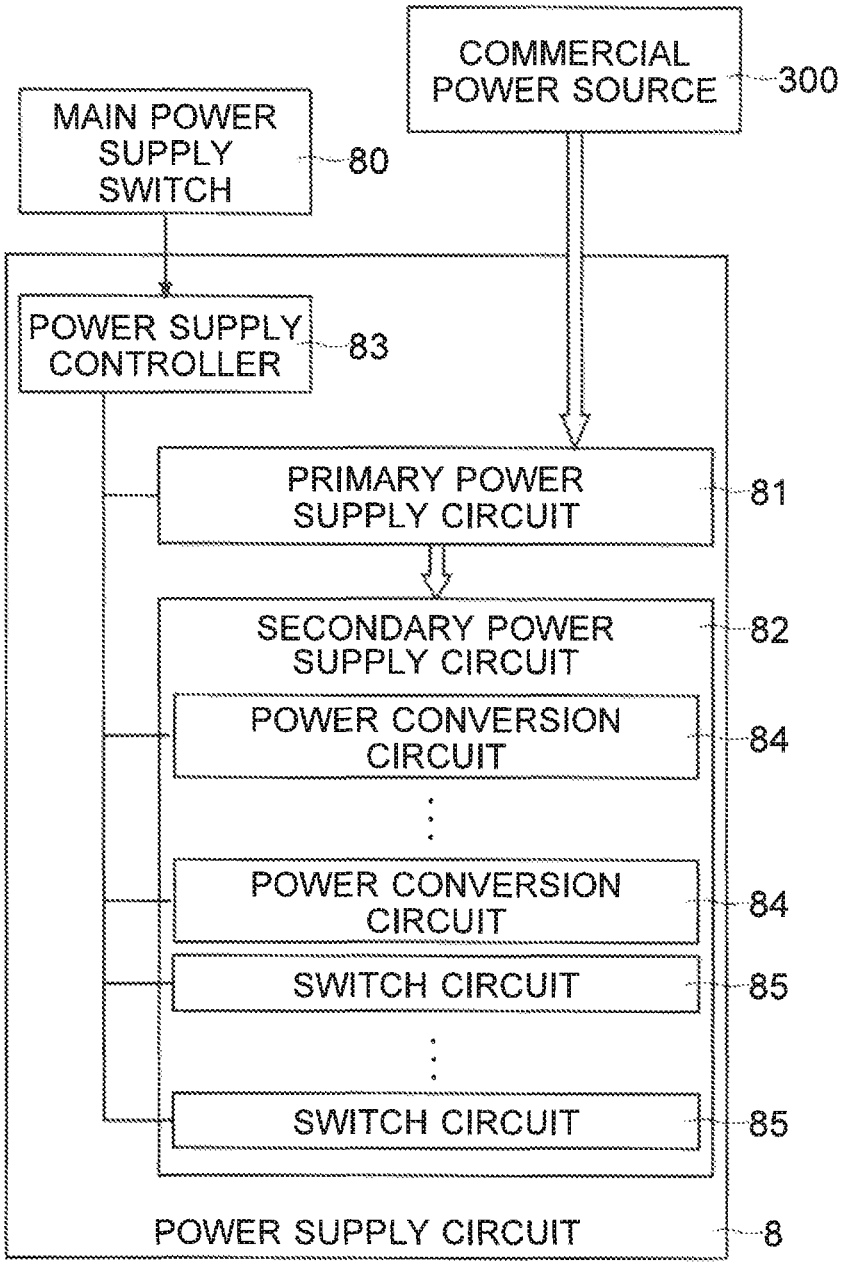
FIG. 3 is a diagram illustrating one example of a power supply circuit included in the multifunction peripheral according to the embodiment.

Next, with reference to FIG. 3, one example of the power supply circuit 8 included in the multifunction peripheral 100 according to the embodiment is described. The multifunction peripheral 100 includes the power supply circuit 8. The power supply circuit 8 is disposed below the image former 6*c* (photosensitive drum 61) (see FIG. 2). The power supply circuit 8 includes a primary power supply circuit 81, a secondary power supply circuit 82, and a power supply controller 83. The primary power supply circuit 81 is connected to a commercial power source 300 (AC power source) via a power cable. The primary power supply circuit 81 is a switching power supply including a transformer, for example. DC voltages are generated from the commercial power source 300 (AC voltage). The primary power supply circuit 81 generates and outputs a predetermined voltage (such as DC 24 V for driving motors).

Various circuits and elements are disposed in the multifunction peripheral 100. The circuits and elements need various voltages for their operations. A plurality of types of voltages are necessary for operations of the main controller 1, the storage medium 2, the communication interface 14, the operation panel 3, the document feeder device 4*a*, the scanner 4*b*, the engine controller 5, and the printing unit 6. Further, a device (integrated circuit) such as the control circuit 11, the image processing circuit 12, the engine control circuit 51, or the engine memory 52 may need a plurality of types of voltages for its operation. Therefore, the secondary power supply circuit 82 generates a plurality of types of DC voltages from the voltage generated by the primary power supply circuit 81.

In order to generate a plurality of types of voltages, the secondary power supply circuit 82 includes a plurality of power conversion circuits 84. The power conversion circuit 84 is, for example, a DC-DC converter or a regulator. Each power conversion circuit 84 outputs a voltage having a predetermined value. The secondary power supply circuit 82 supplies voltages having values necessary for individual components of the multifunction peripheral 100. The components are, for example, the main controller 1, the storage medium 2, the operation panel 3, the document feeder device 4*a*, the scanner 4*b*, the engine controller 5, the printing unit 6, and the heater 7.

The power supply circuit 8 of the multifunction peripheral 100 has a plurality of supply modes (details thereof are described later). Portions supplied with power are different depending on the supply mode. Switch circuits 85 are provided for turning on and off power supply to individual portions (such as the main controller 1, the engine controller 5, the printing unit 6, and the heater 7). The switch circuit 85 includes a switching element such as a transistor. A plurality of switch circuits 85 can be provided.

The power supply controller 83 controls operation (on/off) of the secondary power supply circuit 82 (power conversion circuit 84). In addition, the power supply controller 83 controls on/off of the switch circuit 85.

(Supply Mode)

Figure 4:
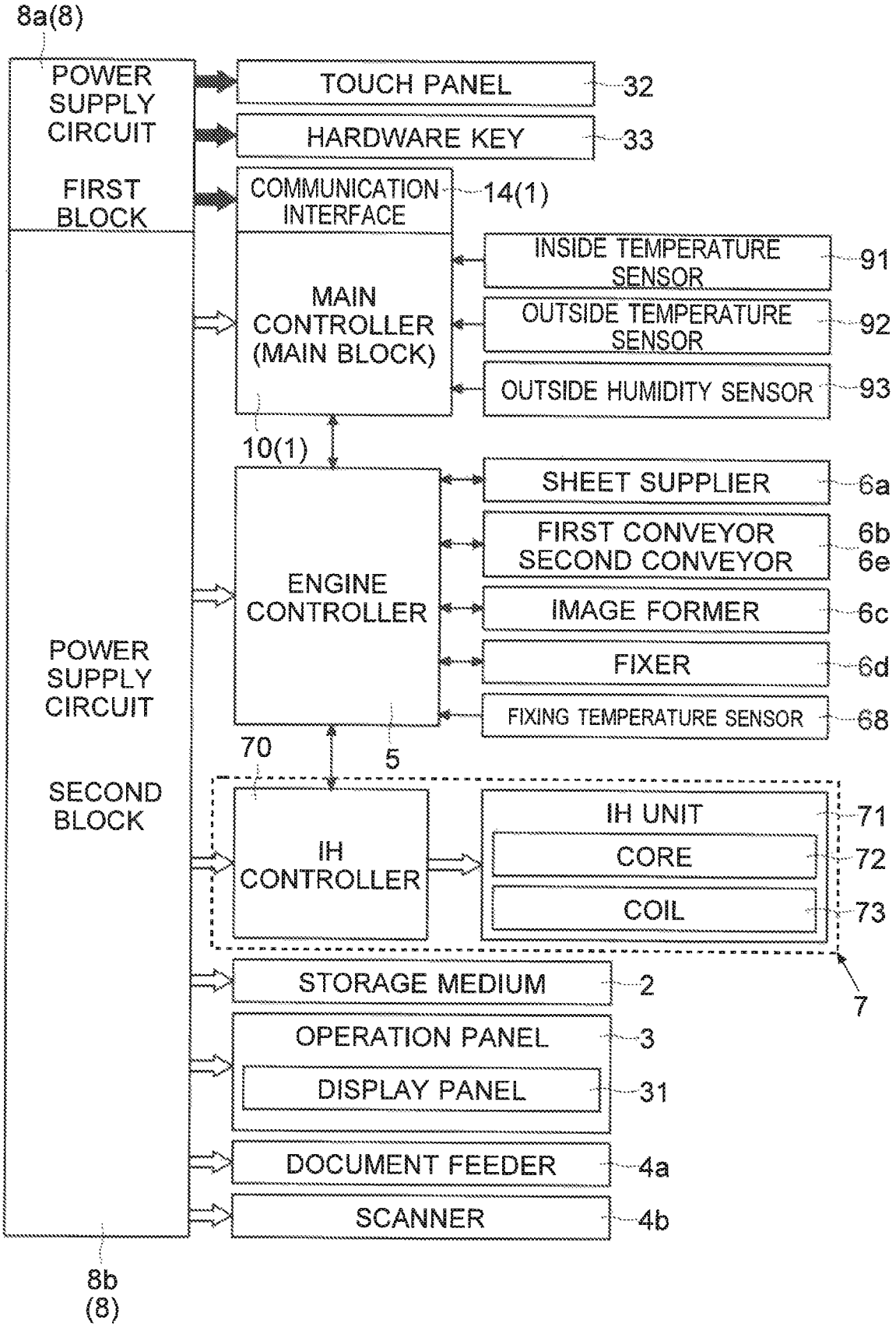
FIG. 4 is a diagram illustrating one example of supply modes of the power supply circuit according to the embodiment.

Next, with reference to FIGS. 4 and 5, one example of the supply modes of the power supply circuit according to the embodiment is described. The power supply circuit 8 supplies power in one of the first supply mode, the second supply mode, and the third supply mode. On the basis of a request from the main controller 1 (the main block 10 or the communication interface 14), the power supply circuit 8 switches the supply modes.

The first supply mode is a mode for supplying power so that printing can be performed by the printing unit 6. The first supply mode may also be referred to as an active mode or a normal mode. More power is supplied by the power supply circuit 8 in the first supply mode than in the second supply mode or the third supply mode. In other words, the first supply mode is a mode having the largest power consumption among the three modes.

More power is supplied in the second supply mode than in the third supply mode. The second supply mode is a first power saving mode (low power mode). The third supply mode is a mode having smaller power consumption than the second supply mode. The third supply mode may also be referred to as a deep sleep mode.

Regardless of the supply mode, the power supply circuit 8 supplies power to the communication interface 14 (a communication block of the main controller 1). The communication interface 14 operates regardless of the supply mode. The power supply circuit 8 includes a first block 8*a*. The first block 8*a* is disposed in the power supply circuit 8 (power supply circuit board). The first block 8*a* is a pert in which circuits and elements for supplying power to portions to be always supplied with power are integrated. Note that a pert of the power supply circuit 8 other than the part in which circuits and elements for supplying power to portions to be always supplied with power are integrated (first block 8*a*) is referred to as a second block 8*b*.

The communication interface 14 receives print data from the computer 200. The power supply circuit 8 supplies power to the communication interface 14 regardless of the supply mode. The communication interface 14 can detect that the computer 200 has issued a request to print (has transmitted print data) in any supply mode. In this way, the multifunction peripheral 100 includes the portion that is always supplied with power.

Further, the power supply circuit 8 may supply power (may apply a voltage) to the touch panel 32 and the hardware key 33 regardless of the supply mode. In this case, the first block 8*a* supplies power to the touch panel 32 and the hardware key 33. The touch panel 32 and the hardware key 33 can detect a user's operation regardless of the supply mode.

[First Supply Mode]

In the first supply mode, the power supply circuit 8 (power supply controller 83) supplies power to the main controller 1 (both the main block 10 and the communication interface 14), the storage medium 2, the document feeder device 4*a*, the scanner 4*b*, the engine controller 5, the printing unit 6, the heater 7 (an IH controller 70 and an IH unit 71), the touch panel 32, the hardware key 33, and the display panel 31 (see FIG. 5). In the first supply mode, the power supply circuit 8 supplies power to each portion of the multifunction peripheral 100, for example. When the power supply starts, each portion is activated to become usable state.

Here, temperature control of the fixer 6*d* is described. As the heater 7 for heating the heating rotating body 66, the IH controller 70 and the IH unit 71 are disposed. In other words, the heater 7 includes the IH controller 70 and the IH unit 71. In addition, in order to detect temperature of the heating rotating body 66, a fixing temperature sensor 68 is disposed. An output of the fixing temperature sensor 68 varies in accordance with temperature of the heating rotating body 66. The output of the fixing temperature sensor 68 is input to the engine controller 5. The engine controller 5 recognizes temperature of the heating rotating body 66.

The IH unit 71 includes a core 72 (magnetic body) and a coil 73. The heating rotating body 66 is heated by magnetic fluxes generated from the coil 73. For this purpose, the circumferential surface of the heating rotating body 66 is made of conductive metal, for example. The core 72 causes the magnetic fluxes generated from the coil 73 to converge so that the magnetic fluxes pass through the heating rotating body 66. The core 72 enables to efficiently heat the heating rotating body 66.

The IH controller 70 is a circuit board including an IH controller circuit and a PWM circuit. The PWM circuit supplies the coil 73 with power fed from the power supply circuit 8. The IH controller circuit controls power to be supplied to the coil 73 (a duty ratio of a PWM signal input to the coil 73 from the PWM circuit). The engine controller 5 periodically recognizes temperature of the heating rotating body 66. Every time when recognizing temperature of the heating rotating body 66, the engine controller 5 instructs the duty ratio to the IH controller 70. The engine controller 5 instructs the duty ratio so that the temperature of the heating rotating body 66 is maintained at a fixing control temperature. The fixing control temperature is a temperature appropriate for melting and fixing the toner. For instance, the fixing control temperature is approximately 150° C. The fixing control temperature depends on a type of the apparatus (toner to be used).

Note that the output of the fixing temperature sensor 68 may be input to the main controller 1 (main block 10). The main controller 1 may recognize temperature of the heating rotating body 66. The main controller 1 may instruct the duty ratio to the IH controller 70.

[Second Supply Mode]

In the second supply mode, the power supply circuit 8 (power supply controller 83) supplies power to the main controller 1 (the main block 10 and the communication interface 14), the storage medium 2, the engine controller 5, the touch panel 32, the hardware key 33, and the display panel 31 (see FIG. 5). Note that when the off-time elapses without any operation to the operation panel 3 (the touch panel 32 and the hardware key 33) after becoming the second supply mode, the power supply circuit 8 may stop power supply to the display panel 31. The power supply to the display panel 31 is minimized. For instance, the power supply circuit 8 (power supply controller 83) may supply power only to an LED disposed and attached to the display panel 31 so that the second supply mode can be recognized (see the mark Δ in FIG. 5).

In contrast, the power supply circuit 8 (power supply controller 83) stops power supply to the document feeder device 4*a*, the scanner 4*b*, the printing unit 6, the heater 7 (the IH controller 70 and the IH unit 71) In the second supply mode. In the second supply mode, the heating rotating body 66 is not maintained at the fixing control temperature. Therefore, power consumption of the multifunction peripheral 100 becomes smaller in the second supply mode than in the first supply mode. In contrast, the main controller 1 and the engine controller 5 are operating. Therefore, the second supply mode is a mode that enables prompt transition to the first supply mode (a state where printing can be performed).

[Third Supply Mode]

In the third supply mode, the power supply circuit 8 (power supply controller 83) supplies power to the communication interface 14, the touch panel 32, and the hardware key 33 (see FIG. 5). Only the first block 8*a* of the power supply circuit 8 operates.

In contrast, the power supply circuit 8 (power supply controller 83) stops power supply to the main controller 1 (main block 10), the storage medium 2, the document feeder device 4*a*, the scanner 4*b*, the engine controller 5, the printing unit 6, the heater 7, and the display panel 31 in the third supply mode. The third supply mode is a mode for reducing power consumption of the multifunction peripheral 100 as much as possible. Therefore, power consumption of the multifunction peripheral 100 becomes smallest in the third supply mode. The power consumption of the multifunction peripheral 100 in the third supply mode is 1 watt or less, for example.

When main power supply of the multifunction peripheral 100 is turned on, the power supply circuit 8 (power supply controller 83) starts the power supply in the first supply mode. Note that a main power supply switch 80 (see FIG. 3) is used for turning on the main power supply to the multifunction peripheral 100. After starting the power supply in the first supply mode, activation of the multifunction peripheral 100 is completed. The multifunction peripheral 100 is activated in the active mode (a state where printing can be performed).

The main controller 1 (main block 10) checks whether or not a first transition condition is satisfied. When the first transition condition is satisfied, the main controller 1 (main block 10) requests the power supply circuit 8 to transfer to the second supply mode. In this way, when the first transition condition is satisfied, the power supply circuit 8 switches from the power supply in the first supply mode to the power supply in the second supply mode. When transferring to the second supply mode, the multifunction peripheral 100 becomes the power saving mode.

The first transition condition is determined in advance. For instance, when there is no operation to the operation panel 3 or no reception of print data for a predetermined first transition time from a first start point, the main controller 1 (main block 10) recognizes that the first transition condition is satisfied. The first start point is the latest time point among the time point when the activation of the multifunction peripheral 100 is completed, the time point when the print job is finished, and the time point when the last operation is performed to the operation panel 3, in the first supply mode. The first transition time is a few tens of seconds to a few minutes, for example. The operation panel 3 may receive setting of the first transition time. In this case, the main controller 1 uses the set first transition time.

Further, in the second supply mode, the main controller 1 (main block 10) checks whether or not a second transition condition is satisfied. In this case, when the second transition condition is satisfied, the main controller 1 (main block 10) requests the power supply circuit 8 to transfer to the third supply mode. In this way, when the second transition condition is satisfied, the power supply circuit 8 switches from the power supply in the second supply mode to the power supply n the third supply mode. When transferring to the third supply mode, the multifunction peripheral 100 becomes a deep sleep mode.

The second transition condition is determined in advance. For instance, when there is no operation to the operation panel 3 or no reception of print data for a predetermined second transition time from a second start point, the main controller 1 (main block 10) recognizes that the second transition condition is satisfied. The second start point is a time point when the second supply mode is started. The second transition time is a few tens of seconds to a few minutes, for example. The operation panel 3 may receive setting of the second transition time. In this case, the main controller 1 uses the set second transition time.

When the communication interface 14 receives the print data in the second supply mode or the third supply mode, the communication interface 14 requests the power supply circuit 8 to transfer to the first supply mode (requests to return to the active mode). Responding to this request, the power supply circuit 8 (power supply controller 83) starts the power supply in the first supply mode. When the power supply in the first supply mode starts, activation of the multifunction peripheral 100 is completed. The multifunction peripheral 100 is activated in the active mode (a state where printing can be performed).

Outputs of the touch panel 32 and the hardware key 33 are input to the communication interface 14, too. In the third supply mode, the communication interface 14 recognizes that the touch panel 32 or the hardware key 33 has been operated. Note that outputs of the touch panel 32 and the hardware key 33 may be input to the power supply circuit 8. When the power supply circuit 8 recognizes that the touch panel 32 or the hardware key 33 is operated in the third supply mode, the power supply circuit 8 starts the power supply in the second supply mode (returns to the power saving mode). In this way, the main controller 1 (main block 10) and the engine controller 5 are restarted. Further, the main controller 1 controls the display panel 31 to start displaying.

In the second supply mode, the operation panel 3 can be operated. When the operation panel 3 receives an instruction to start execution of a job, the main controller 1 (main block 10) requests the power supply circuit 8 to transfer to the first supply mode (requests to return to the active mode). Responding to this request, the power supply circuit 8 (power supply controller 83) starts the power supply in the first supply mode. When the power supply in the first supply mode starts, activation of the printing unit 6, the document feeder device 4*a*, and the scanner 4*b* is completed. The multifunction peripheral 100 can perform a job such as copying or scan transmission.

(Selection Concerning Condensation Prevention Function)

Figure 6:
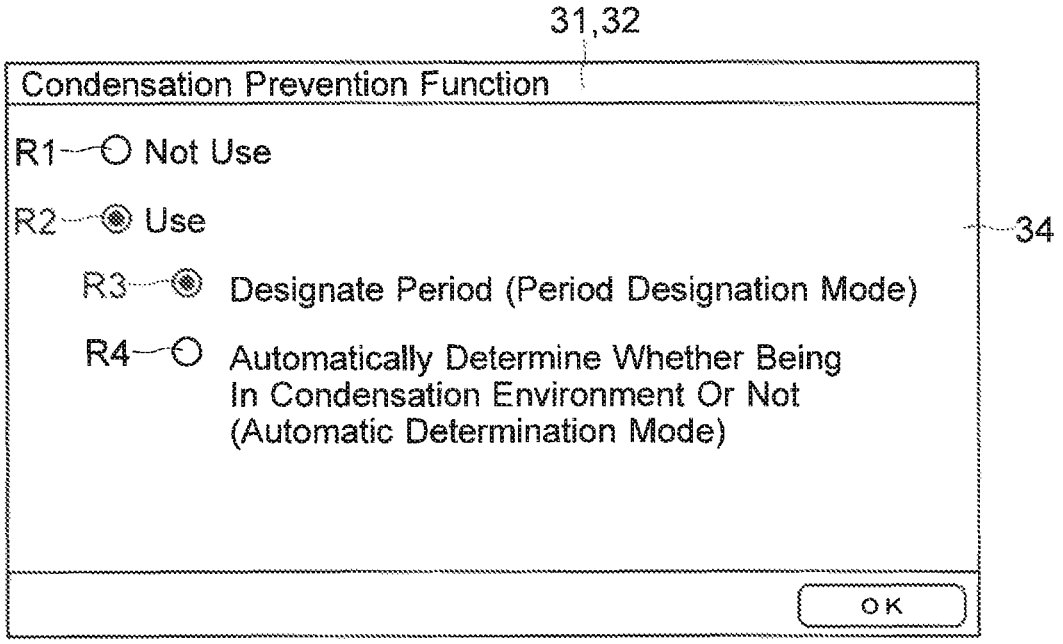
FIG. 6 is a diagram illustrating one example of a condensation prevention function selecting screen according to the embodiment.

Next, with reference to FIG. 6, one example of mode selection in the multifunction peripheral 100 according to the embodiment is described. The multifunction peripheral 100 has a condensation prevention function. Using the operation panel 3, it is possible to select whether or not to use the condensation prevention function.

The condensation prevention function is a function of preventing the power supply circuit 8 from becoming the third supply mode. While the main power supply of the multifunction peripheral 100 is turned on and the condensation prevention function is functioning, the power supply circuit 8, the main controller 1 (the main block 10 and the communication interface 14), and the engine controller 5 continue to operate. These portions generate heat, which prevents temperature decrease of the image former 6*c*, particularly the photosensitive drum 61 inside the multifunction peripheral 100.

As time elapses after room heating is turned off, room temperature decreases. However, when the main power supply of the multifunction peripheral 100 is not turned off, and when the condensation prevention function is enabled, heat generated from the power supply circuit 8, the main controller 1, and the engine controller 5 keeps the photosensitive drum 61 at a temperature higher than the room temperature. For instance, it is supposed that the room heating is turned off when business hours are over and that the next morning the room heating is turned on when business hours start. The air heated by the room heating flows into the multifunction peripheral 100. The air heated by the room heating reaches the photosensitive drum 61. However, the photosensitive drum 61 has been continuously warmed.

In particular, the power supply circuit 8 includes a plurality of power conversion circuits 84. The power conversion circuits 84 generate heat. In addition, the power supply circuit 8 is disposed below the photosensitive drum 61. Heated or warmed air rises so as to efficiently warm up the photosensitive drum 61. When the condensation prevention function is enabled, temperature of the photosensitive drum 61 is not decreased to the extent that condensation occurs. When contacting the air heated by the room heating, the photosensitive drum 61 does not generate condensation. Even in a very cold environment such as a construction site in winter, it is possible to prevent condensation on the photosensitive drum 61 or a portion related to toner image formation. Even when printing is performed when room temperature is largely increased due to the room heating, image quality abnormality (Image deletion) due to condensation does not occur.

When a predetermined operation is performed to the operation panel 3, the main controller 1 (main block 10) controls the display panel 31 to display a condensation prevention function selecting screen 34. Four radio buttons are disposed on the condensation prevention function selecting screen 34. A first radio button R1 and a second radio button R2 are used for selecting whether or not to use the condensation prevention function. The operation panel 3 receives an operation of the first radio button R1 as a selection not to use the condensation prevention function. The operation panel 3 receives an operation of the second radio button R2 as a selection to use the condensation prevention function.

Further, a third radio button R3 and a fourth radio button R4 are used for selecting a mode of the condensation prevention function. The operation panel 3 receives an operation of the third radio button R3 as selection to use a period designation mode. The operation panel 3 receives an operation of the fourth radio button R4 as selection to use an automatic determination mode.

The period designation mode is a mode for the user to designate a period during which the condensation prevention function is used. When the period designation mode is selected (when the third radio button R3 is operated), the main controller 1 (main block 10) controls the display panel 31 to display a screen for designating the period. For instance, the main controller 1 (main block 10) may control the display panel to display a screen for inputting month, day, and time of start of the period and month, day, and time of end of the period.

Further, the operation panel may receive designation of month and day or designation of month to be a specified period (to be included in the specified period). For instance, the main controller 1 controls the display panel 31 to display a calendar. The user designates month and day to be included in the specified period, in consideration of season or month and day in which condensation will occur when room heating is turned on. Further, the operation panel 3 may receive setting of the specified period by unit of month. Note that it may be possible to designate month and day in which the condensation prevention function is not used in the specified period (e.g. to exclude a long absence).

When the period (month and day) is designated, the main controller 1 (main block 10) controls the storage medium 2 to store specified period data D1 in a nonvolatile manner (see FIG. 1). The specified period data D1 is data indicating the designated period during which the condensation prevention function is used. By checking the specified period data D1, the main controller 1 can check whether or not today is within the designated period.

Note that in order to enable to check current (todays) month and day, the main controller 1 may be provided with the clock circuit 13 (see FIG. 1). The clock circuit 13 is a circuit for counting year, month, day, and time. The clock circuit 13 is a real time clock (RTC) circuit, for example.

The automatic determination mode is a mode for determining whether the multifunction peripheral 100 (image forming apparatus) is in a condensation environment or not. The condensation environment in this description means an environment in which condensation may occur on the photosensitive drum 61 when room heating is turned on. When determining being in the condensation environment, the main controller 1 (main block 10) controls the storage medium 2 to store condensation environment data D2 in a nonvolatile manner (see FIG. 1). The condensation environment data D2 is flag data indicating that it is determined being in the condensation environment. By checking the storage medium 2 at a predetermined address (an address where the condensation environment data D2 is stored), the main controller 1 can check the determination result whether being in the condensation environment or not.

While the condensation environment data D2 is stored in the storage medium 2 (while it is recognized being in the condensation environment), the main controller 1 and the power supply circuit 8 enable the condensation prevention function. When the condensation environment data D2 is not stored in the storage medium 2, the main controller 1 and the power supply circuit 8 do not use the condensation prevention function (disable the same). Details of the determination whether being in the condensation environment or not is described later.

(Mode Transition in Condensation Prevention Function)

Figure 7:
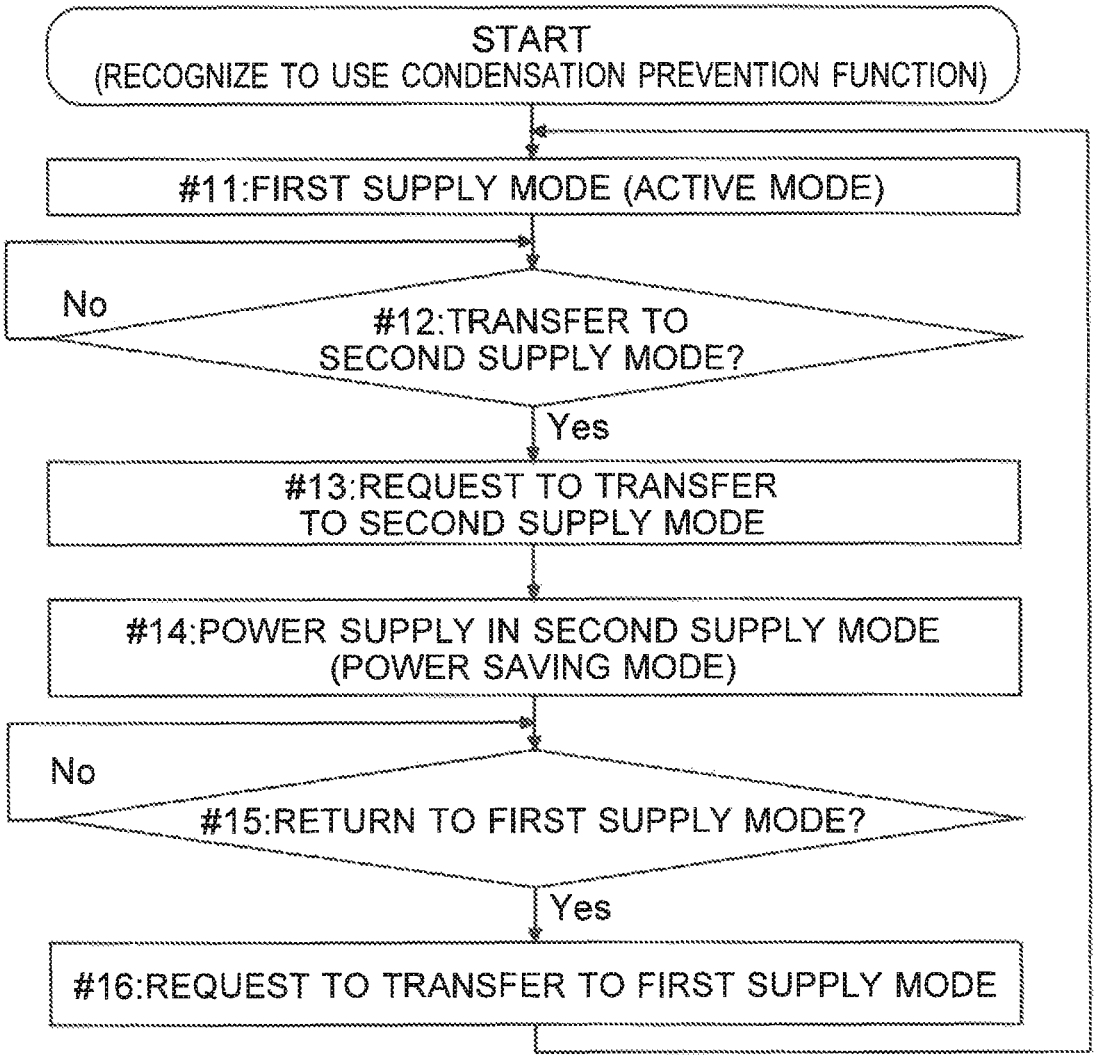
FIG. 7 illustrates one example of transition of the supply modes when using a condensation prevention function according to the embodiment.
Figure 8:
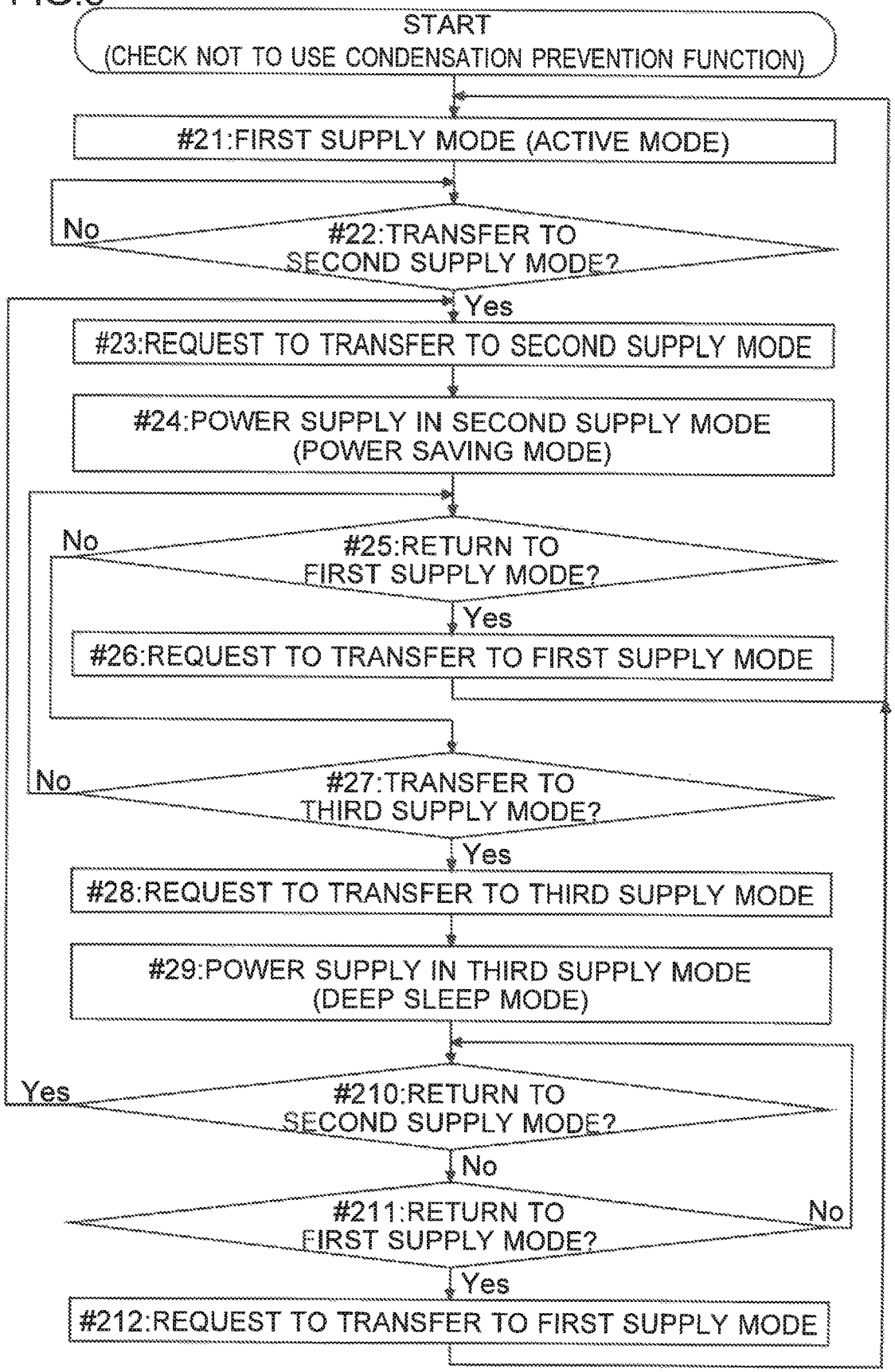
FIG. 8 illustrates one example of transition of the supply modes when not using the condensation prevention function according to the embodiment.

Next, with reference to FIGS. 7 and 8, there is described one example of a flow of transition in the supply mode when the condensation prevention function according to the embodiment is used. FIG. 7 is a flowchart when the condensation prevention function is used. In other words, FIG. 7 is a flowchart when the condensation prevention function is enabled.

The flowchart of FIG. 7 is executed in the following cases:

(1) where the condensation prevention function and the period designation mode are selected to be used, and it is within the specified period (the current time point is included in the specified period), and (2) where the condensation prevention function and the automatic determination mode are selected to be used, and the main controller 1 recognizes being in the condensation environment (the condensation environment data D2 is stored).

The flow of FIG. 7 starts at a time point when the main controller 1 (main block 10) checks that the condition (1) or (2) is satisfied. In other words, it starts at a time point when the main controller 1 checks that the condensation prevention function is to be used. By checking the specified period data D1 or the condensation environment data D2, the main controller 1 checks whether or not to use the condensation prevention function.

The main controller 1 (main block 10) may check whether or not the condition (1) or (2) is satisfied when the main power supply of the multifunction peripheral 100 is turned on (when the main controller 1 is activated). Further, the main controller 1 (main block 10) may check whether or not the condition (1) or (2) is satisfied when returning to the first supply mode (active mode) from the third supply mode (deep sleep mode). Further, the main controller 1 (main block 10) may check whether or not the condition (1) or (2) is satisfied when returning to the first supply mode from the second supply mode (power saving mode).

Note that the main controller 1 (main block 10) may check whether or not the condition (1) or (2) is satisfied also when returning to the second supply mode (power saving mode) from the third supply mode (deep sleep mode), too. In this case, the controller (main block 10) may start the process from Step #15.

First, the power supply circuit 8 becomes the first supply mode (Step #11). When power supply from the power supply circuit 8 starts, the main controller 1, the storage medium 2, the operation panel 3, the document feeder device 4*a*, the scanner 4*b*, the engine controller 5, the printing unit 6, the heater 7, and the like are activated. The multifunction peripheral 100 is activated in the active mode.

The main controller 1 (main block 10) continues to check whether or not to transfer to the second supply mode (whether or not the first transition condition is satisfied) (Step #12, No in Step #12 to Step #12). When it is to transfer to the second supply mode (Yes in Step #12), the main controller 1 (main block 10) requests the power supply circuit 8 to transfer to the second supply mode (Step #13). In accordance with this request, the power supply circuit 8 performs the power supply in the second supply mode (Step #14). In this way, the multifunction peripheral 100 becomes the power saving mode.

Note that in the second supply mode, when there is no operation to the operation panel 3 for a predetermined time, the main controller 1 (main block 10) may request the power supply circuit 8 to stop power supply to the display panel 31. On the basis of this request, the power supply circuit 8 stops power supply to the display panel 31. It is possible to keep the display panel 31 without being used and lighted for a long time. Power consumption of the multifunction peripheral 100 can be reduced, and the life of the display panel 31 can be increased.

In the specified period, or when the condensation environment data D2 is stored in the storage medium 2, during the second supply mode, the main controller 1 continues to check whether or not to return to the first supply mode (Step #15, No in Step #15 to Step #15). When the return condition to the first supply mode is satisfied, the main controller 1 requests the power supply circuit 8 to transfer to the first supply mode (Step #16). In accordance with this request, the power supply circuit 8 performs the power supply in the first supply mode (Step #11). In this way, the multifunction peripheral 100 becomes the active mode.

In this way, in the specified period, or when the condensation environment data D2 is stored in the storage medium 2, the main controller 1 (the main block 10 and the communication interface 14) disables the power supply circuit 8 to perform power supply in the third supply mode. The power supply circuit 8 does not perform power supply in the third supply mode.

Next, the flowchart of FIG. 8 is described. FIG. 8 is a flowchart when the condensation prevention function is not used. The flowchart of FIG. 8 is executed in the following cases:

(4) where it is selected not to use the condensation prevention function, (5) where it is selected to use the condensation prevention function and the period designation mode, and it is not within the specified period, and (6) where it is selected to use the condensation prevention function and the automatic determination mode, and the main controller 1 does not recognize being in the condensation environment (the condensation environment data D2 is not stored).

The flow of FIG. 8 starts at a time point when the main controller 1 (main block 10) checks that one of the conditions (4) to (6) is satisfied. In other words, it starts at a time point when the main controller 1 checks that the condensation prevention function is not to be used. By checking the specified period data D1 or the condensation environment data D2, the main controller 1 can check whether or not to use the condensation prevention function.

The main controller 1 (main block 10) may check whether or not one of the conditions (4) to (6) is satisfied when the main power supply of the multifunction peripheral 100 is turned on (when the main controller 1 is activated). Further, the main controller 1 (main block 10) may check whether or not one of the conditions (4) to (6) is satisfied when returning to the first supply mode (active mode) from the third supply mode (deep sleep mode). Further, the main controller 1 (main block 10) may check whether or not one of the conditions (4) to (6) is satisfied when returning to the first supply mode from the second supply mode (power saving mode).

Note that the main controller 1 (main block 10) may check whether or not one of the conditions (4) to (6) is satisfied also when returning to the second supply mode (power saving mode) from the third supply mode (deep sleep mode), too. In this case, the controller (main block 10) may start the process from Step #25.

First, the power supply circuit 8 becomes the first supply mode (Step #21). When power supply from the power supply circuit 8 starts, the main controller 1, the storage medium 2, the operation panel 3, the document feeder device 4*a*, the scanner 4*b*, the engine controller 5, the printing unit 6, the heater 7, and the like are activated. The multifunction peripheral 100 is activated in the active mode.

The main controller 1 continues to check whether or not to transfer to the second supply mode (Step #22, No in Step #22 to Step #22). When the first transition condition is satisfied (Yes in Step #22), the main controller 1 requests the power supply circuit 8 to transfer to the second supply mode (Step #23). In accordance with this request, the power supply circuit 8 performs the power supply in the second supply mode (Step #24). In this way, the multifunction peripheral 100 becomes the power saving mode.

In the second supply mode, the main controller 1 checks whether or not the return condition to the first supply mode is satisfied (Step #25). When the return condition to the first supply mode is satisfied (Yes in Step #25), the main controller 1 (main block 10) requests the power supply circuit 8 to transfer to the first supply mode (Step #26). In accordance with this request, the power supply circuit 8 performs the power supply in the first supply mode (return to Step #21). In this way, the multifunction peripheral 100 becomes the active mode.

When the return condition to the first supply mode is not satisfied (No in Step #25), the main controller 1 (main block 10) checks whether or not to transfer to the third supply mode (whether or not the second transition condition is satisfied) (Step #27). When the condensation prevention function is not used, when it is not within the specified period, or when the condensation environment data D2 is not stored, the main controller 1 (main block 10) performs the check in Step #27.

When it is not to transfer to the third supply mode (No in Step #27), the main controller 1 (main block 10) performs Step #25 (returns to Step #25). When the second transition condition is satisfied (Yes in Step #27), the main controller 1 (main block 10) requests the power supply circuit 8 to transfer to the third supply mode (Step #28). In accordance with this request, the power supply circuit 8 performs the power supply in the third supply mode (Step #29). In this way, the multifunction peripheral 100 becomes the deep sleep mode.

In the third supply mode, the main controller 1 (communication interface 14) checks whether or not to return to the second supply mode (Step #210). When the return condition to the second supply mode is satisfied (Yes in Step #210), the communication interface 14 requests the power supply circuit 8 to transfer to the second supply mode (returns to Step #23). In accordance with this request, the power supply circuit 8 performs the power supply in the second supply mode (Step #24). In this way, the multifunction peripheral 100 becomes the power saving mode. The multifunction peripheral 100 becomes ready to receive job setting from the user.

When the return condition to the second supply mode is not satisfied (No in Step #210), the main controller 1 (communication interface 14) checks whether or not to return to the first supply mode (Step #211). When the return condition to the first supply mode is not satisfied (No in Step #211), the main controller 1 (communication interface 14) performs Step #210 (returns to Step #210). When the return condition to the first supply mode is satisfied (Yes in Step #211), the communication interface 14 requests the power supply circuit 8 to transfer to the first supply mode (Step #212). In accordance with this request, the power supply circuit 8 performs the power supply in the first supply mode (returns to Step #21). In this way, the multifunction peripheral 100 becomes the active mode. The multifunction peripheral 100 returns to a state capable of performing a job.

In this way, when it is not in the specified period, or when the condensation environment data D2 is not stored in the storage medium 2, the main controller 1 controls to perform the power supply in the third supply mode. The power supply circuit 8 performs the power supply in the third supply mode.

While the main power supply of the multifunction peripheral 100 is turned on (is on), the main controller 1 (the main block 10 or the communication interface 14) continues to check whether or not to switch the supply modes. When the main power supply of the multifunction peripheral 100 is turned off (is off), the flow of FIGS. 7 and 8 is finished.

(Determination of Condensation Environment)

Figure 9:
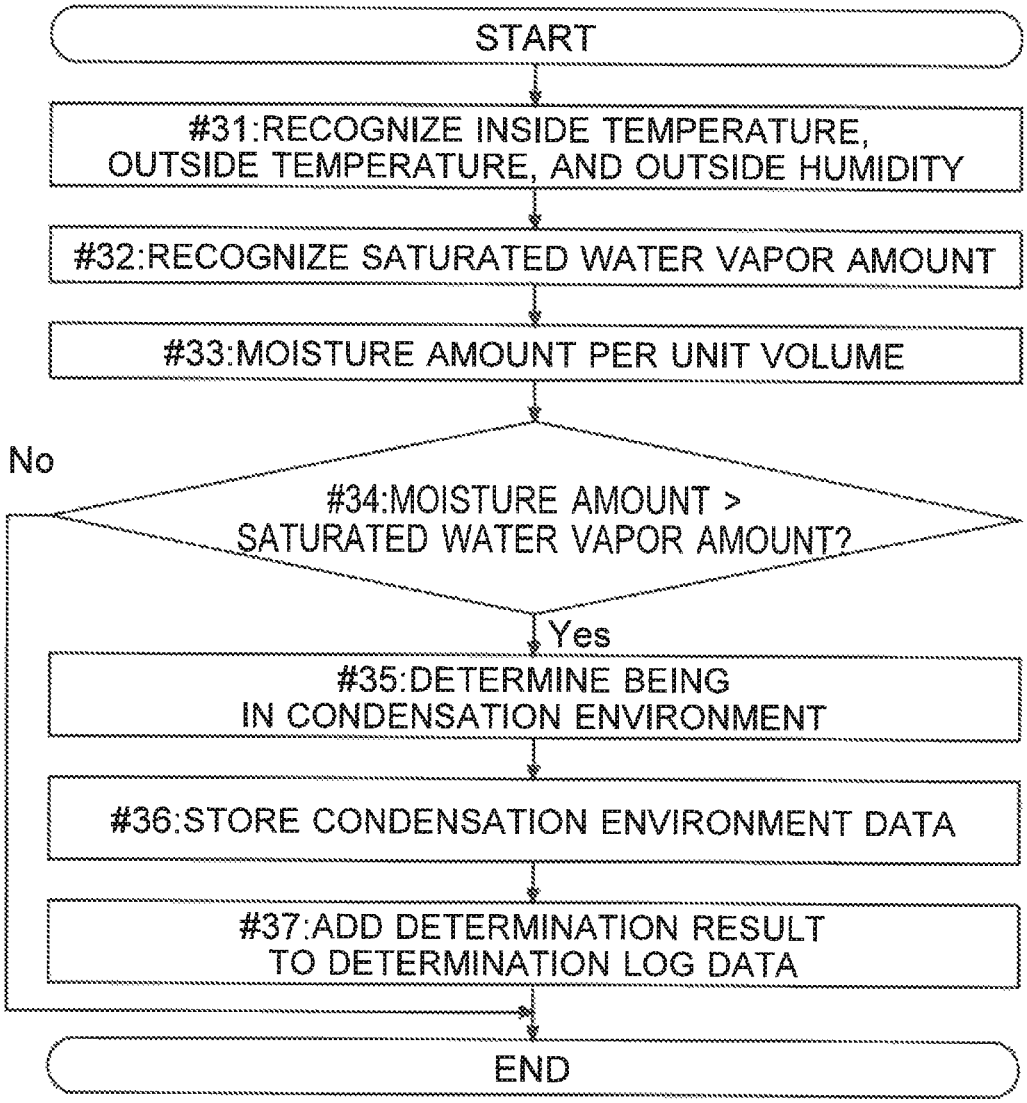
FIG. 9 is a diagram illustrating one example of a first determination process according to the embodiment.
Figure 11:
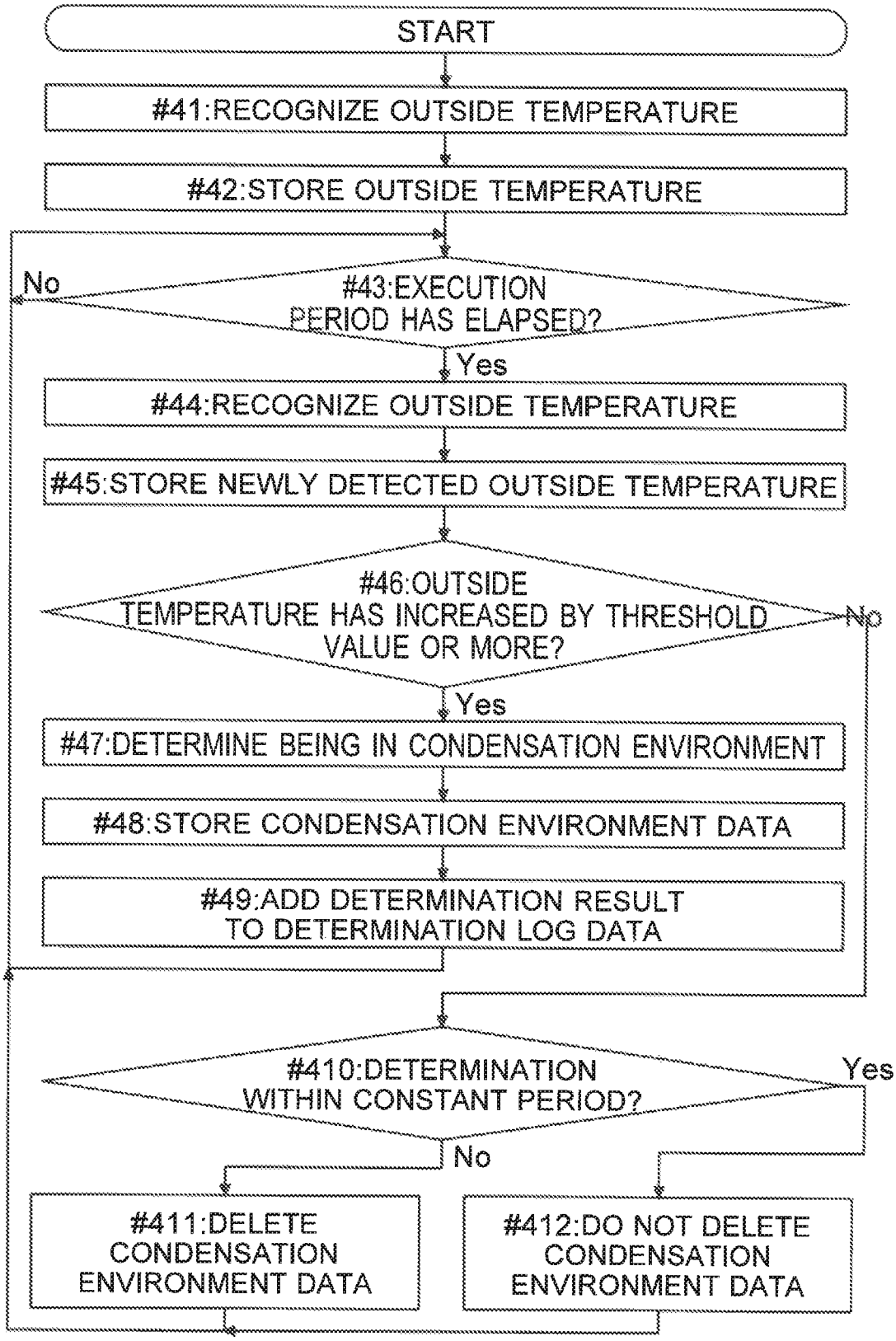
FIG. 11 is a diagram illustrating one example of a second determination process according to the embodiment.

Next, with reference to FIGS. 9 to 11, one example of a determination process in an automatic determination mode according to the embodiment is described. First, for determination whether or not being in the condensation environment in the automatic determination mode, the multifunction peripheral 100 includes an inside temperature sensor 91, an outside temperature sensor 92, and an outside humidity sensor 93 (see FIG. 4). The inside temperature sensor 91 is a sensor for measuring temperature inside the multifunction peripheral 100. The inside temperature sensor 91 is disposed at a position facing the photosensitive drum 61, for example. The output of the inside temperature sensor 91 varies in accordance with air temperature in the vicinity of the photosensitive drum 61. The output of the inside temperature sensor 91 is input to the main controller 1 (main block 10). On the basis of the output of the inside temperature sensor 91, the main controller 1 (main block 10) recognizes the inside temperature.

The outside temperature sensor 92 is a sensor for measuring temperature outside the multifunction peripheral 100. The outside temperature sensor 92 is disposed at a vent hole portion of the multifunction peripheral 100 or outside the same, for example. The output of the outside temperature sensor 92 varies in accordance with air temperature outside the multifunction peripheral 100. The output of the outside temperature sensor 92 is input to the main controller 1 (main block 10). In accordance with the output of the outside temperature sensor 92, the main controller 1 (main block 10) recognizes the outside temperature.

The outside humidity sensor 93 is a sensor for measuring air humidity outside the multifunction peripheral 100. The outside humidity sensor 93 is disposed at a vent hole portion of the multifunction peripheral 100 or outside the same, for example. The output of the outside humidity sensor 93 varies in accordance with air humidity outside the multifunction peripheral 100. The output of the outside humidity sensor 93 is input to the main controller 1 (main block 10). In accordance with the output of the outside humidity sensor 93, the main controller 1 (main block 10) recognizes outside humidity (relative humidity of outside air).

With reference to FIG. 9, one example of a first determination process is described. When the main power supply of the multifunction peripheral 100 is turned on, or when it is activated, returning from the third supply mode (deep sleep mode) to the first supply mode (active mode) or the second supply mode (power saving mode), the main controller 1 (main block 10) starts the first determination process. Therefore, the flow of FIG. 9 starts at a time point when the main power supply of the multifunction peripheral 100 is turned on or when returning from the third supply mode to the first supply mode or the second supply mode (power saving mode).

On the basis of the outputs of the sensors, the main controller 1 (main block 10) recognizes the inside temperature, the outside temperature, and the outside humidity (relative humidity) (Step #31). Next, the main controller 1 (main block 10) recognizes a saturated water vapor amount corresponding to the inside temperature (Step #32). For recognizing the saturated water vapor amount, absolute humidity data D3 is stored in the storage medium 2 (see FIG. 1).

FIG. 10 is a diagram illustrating one example of the absolute humidity data D3. The absolute humidity data D3 is data defining saturated water vapor amounts corresponding to combinations of temperature and humidity. For instance, the absolute humidity data D3 has a table form. The main controller 1 (main block 10) refers to the absolute humidity data D3, so as to recognize the saturated water vapor amount at the recognized inside temperature.

Next, on the basis of the outside temperature and the outside humidity, the main controller 1 (main block 10) determines moisture amount per unit volume of outside air (absolute humidity) (Step #33). The unit of moisture amount per unit volume is grams/cubic meter. Specifically, the main controller 1 (main block 10) refers to the absolute humidity data D3. Then, the main controller 1 (main block 10) determines the saturated water vapor amount corresponding to the outside temperature. The main controller 1 (main block 10) multiplies the saturated water vapor amount corresponding to the outside temperature by the outside humidity, so as to determine the moisture amount per unit volume.

Next, the main controller 1 (main block 10) checks whether or not the determined moisture amount is larger than the recognized saturated water vapor amount at the inside temperature (Step #34). When the determined moisture amount is larger than the recognized saturated water vapor amount (Yes in Step #34), it is assumed that water drops will attach to the photosensitive drum 61 when the outside air (inside the room) contacts the cooled photosensitive drum 61. Therefore, when the determined moisture amount is larger than the recognized saturated water vapor amount (Yes in Step #34), the main controller 1 (main block 10) determines being in the condensation environment (Step #35). In other words, the main controller 1 determines that the multifunction peripheral 100 is installed in the condensation environment.

When determining being in the condensation environment, the main controller 1 (main block 10) controls the storage medium 2 to store the condensation environment data D2 (a flag indicating being in the condensation environment) in a nonvolatile manner (Step #36). When the flag indicating being in the condensation environment is already written in the storage medium 2, the main controller 1 (main block 10) may skip Step #36.

Next, the main controller 1 (main block 10) adds the result determining being in the condensation environment to determination log data D4 (Step #37). The storage medium 2 stores the determination log data D4 in a nonvolatile manner (see FIG. 1). For instance, the main controller 1 (main block 10) adds date and time when being in the condensation environment is determined to the last line of the determination log data D4. Then, the main controller 1 (main block 10) finishes this flow (END). On the contrary, when the moisture amount is equal to or smaller than the recognized saturated water vapor amount at the inside temperature (No in Step #34), the main controller 1 (main block 10) finishes this flow (END).

Next, with reference to FIG. 11, one example of the second determination process is described. While the main power supply of the multifunction peripheral 100 is turned on, the main controller 1 (main block 10) periodically performs the second determination process. For instance, the main controller 1 (main block 10) performs the second determination process once every time when a predetermined execution period elapses after the main power supply is turned on. The execution period is one hour to a few hours, for example. Note that the operation panel 3 may receive setting of the execution period of the second determination process. In this case, the main controller 1 (main block 10) performs the second determination process on the basis of the set execution period.

When the second determination process is performed, the power supply circuit 8 may be supplying power in the third supply mode. In this case, the main block 10 is not working. Therefore, in the third supply mode, the communication interface 14 recognizes that a time point to perform the second determination process has come (that the execution period has elapsed). When the time point to perform the second determination process has come, the communication interface 14 requests the power supply circuit 8 to temporarily restart power supply to the main controller 1 (main block 10), the storage medium 2, and the outside temperature sensor 92.

The temporary restart allows the main controller 1 (main block 10), the storage medium 2, and the outside temperature sensor 92 to temporarily resume. Then, the main controller 1 (main block 10) performs the second determination process. When the second determination process (the flowchart of FIG. 11) is completed, the main controller 1 (main block 10) requests to stop power supply to the main block 10, the storage medium 2, and the outside temperature sensor 92. In this way, the temporary power supply resumption for the second determination process is finished.

The flow of FIG. 11 starts at a time point when the main power supply of the multifunction peripheral 100 is turned on. First, the main controller 1 (main block 10) recognizes outside temperature (Step #41). The main controller 1 detects outside temperature on the basis of the output of the outside temperature sensor 92. The main controller 1 (main block 10) controls the storage medium 2 to store the detected outside temperature in a nonvolatile manner (Step #42).

Next, the main controller 1 (the main block 10 or the communication interface 14) continues to check whether or not the execution period of the second determination process has elapsed from the last storing of the outside temperature (Step #43, No in Step #43 to Step #43). When the execution period has elapsed (Yes in Step #43), the main controller 1 recognizes outside temperature (Step #44). The main controller 1 controls the storage medium 2 to store the newly detected outside temperature in a nonvolatile manner (Step #45).

Then, the main controller 1 (main block 10) checks whether or not the outside temperature has increased during the execution period by a predetermined threshold value D5 or more (Step #46). Specifically, the main controller 1 (main block 10) subtracts the outside temperature at the time one execution period before from the newly detected outside temperature. When the value obtained by the subtraction is the threshold value D5 or larger, the main controller 1 (main block 10) determines Yes in Step #46. When the value obtained by the subtraction is smaller than the threshold value D5, the main controller 1 (main block 10) determines No in Step #46.

The threshold value D5 is determined in advance. The storage medium 2 stores the threshold value D5 in a nonvolatile manner. The threshold value D5 is a temperature in a range from 10° C. to 15C, for example. Further, the operation panel 3 may receive setting of the threshold value D5. In this case, the main controller 1 (main block 10) controls the storage medium 2 to store the set threshold value D5. The main controller 1 (main block 10) uses the threshold value D5 set in the process of Step #46.

Here, when the condensation prevention function is enabled (while not transferring to the third supply mode), the photosensitive drum 61 is warmed by heat from the power supply circuit 8, the main controller 1, and the engine controller 5. The inside temperature is higher than cold room temperature. It may be difficult to accurately determine whether being in the condensation environment or not only by the first determination process.

Therefore, the main controller 1 (main block 10) performs the second determination process (the process in Step #46). The process in Step #46 is a process for checking whether or not the room temperature has increased rapidly due to room heating. In an environment having a rapid increase of room temperature, condensation tends to occur on the photosensitive drum 61. By performing the second determination process, it is possible to prevent misdetermination of the condensation environment.

When the outside temperature increases by the threshold value D5 or more (Yes in Step #46), the main controller 1 (main block 10) determines that the multifunction peripheral 100 is installed in the condensation environment (Step #47). Then, the main controller 1 (main block 10) controls the storage medium 2 to store the condensation environment data D2 (flag indicating being in the condensation environment) in a nonvolatile manner (Step #48). When the flag indicating being in the condensation environment is already written in the storage medium 2, the main controller 1 (main block 10) may skip Step #48. Further, the main controller 1 (main block 10) adds the result determining being in the condensation environment to the determination log data D4 (Step #49). For instance, the main controller 1 (main block 10) adds date and time when being in the condensation environment is determined to the last line of the determination log data D4. Then, the main controller 1 (the main block 10 or the communication interface 14) performs Step #43 (returns to Step #43). In this way, it is periodically determined whether being in the condensation environment or not.

When the increase in the outside temperature is the threshold value D5 or less (No in Step #46), the main controller 1 (main block 10) checks whether or not being in the condensation environment has been determined within a predetermined constant period (Step #410). A determination result of a first determination process and a determination result of a second determination process are both considered.

Specifically, the main controller 1 (main block 10) refers to the determination log data D4. The constant period is determined to be in a range from one week to one month, for example. The operation panel 3 may receive setting of the constant period. In this case, the main controller 1 (main block 10) controls the storage medium 2 to store the set constant period. The main controller 1 (main block 10) uses the constant period set in the process of Step #49.

When being in the condensation environment has not been determined within the constant period (No in Step #410), the main controller 1 (main block 10) deletes the condensation environment data D2 (Step #411). The main controller 1 deletes the flag indicating that the multifunction peripheral 100 is installed in the condensation environment. When the data (flag) is deleted, there is no condensation environment data D2 after that, and hence the main controller 1 (main block 10) recognizes that the multifunction peripheral 100 is not in the condensation environment.

When being in the condensation environment has been determined within the constant period (Yes in Step #410), the main controller 1 (main block 10) does not delete the condensation environment data D2 (flag) (Step #412). It is because it cannot be immediately determined that warm season has come.

After Step #411 and Step #412, the main controller 1 (the main block 10 or the communication interface 14) performs Step #43 (returns to Step #43). In this way, the main controller 1 (main block 10) periodically performs the second determination process. Regardless whether being in the condensation environment or not, the main controller 1 performs the second determination process.

In this way, the image forming apparatus that can use the period designation mode includes the printing unit 6, the heater 7, the controller (the main controller 1 and the engine controller 5), and the power supply circuit 8. The printing unit 6 includes the photosensitive drum 61 for forming a toner image. Further, the printing unit 6 includes the heating rotating body 66 for heating the paper sheet with the transferred toner image. The heater 7 heats the heating rotating body 66. The controller includes the control circuit 11 and performs controlling. The power supply circuit 8 turns on/off power supply to the printing unit 6, the heater 7, and the controller. The power supply circuit 8 supplies power in one of the first supply mode, the second supply mode, and the third supply mode. The first supply mode is a mode for supplying power so that printing can be performed by the printing unit 6, and more power is supplied in the first supply mode than in the second supply mode or the third supply mode. More power is supplied in the second supply mode than in the third supply mode. In a period other than a predetermined specified period, when a predetermined first transition condition is satisfied, the power supply circuit 8 switches from the power supply in the first supply mode to the power supply in the second supply mode. When a predetermined second transition condition is satisfied, the power supply circuit 8 switches from the power supply in the second supply mode to the power supply in the third supply mode. In the specified period, when the first transition condition is satisfied, the power supply circuit 8 switches from the power supply in the first supply mode to the power supply in the second supply mode. The power supply circuit 8 maintains the second supply mode without performing the switching from the power supply in the second supply mode to the power supply in the third supply mode.

Unless the main power supply is turned off, it is possible to intentionally prevent transfer to the third supply mode (deep sleep mode) in the specified period. It is possible to intentionally increase power consumption of the image forming apparatus so that condensation does not occur. The type of power supply mode of the power supply circuit 8 can be switched in accordance with whether being in the specified period or not.

More units consume power in the second supply mode than in the third supply mode. In the specified period, the unit (such as the power supply circuit 8) that consumes power in the second supply mode generate heat, which can warm the rotating body (such as the photosensitive drum 61) related to toner image formation. Even when room heating is turned off and room temperature is decreased, temperature of the photosensitive drum 61 can be prevented from decreasing. The photosensitive drum 61 can be prevented from being cooled excessively. The temperature of the photosensitive drum 61 can be maintained so that condensation does not occur when the room temperature is increased as the room heating is turned on. Further, not only the photosensitive drum 61 but also the units related to toner image formation (such as the development device 64) can also be warmed. The entire units related to toner image formation can prevent occurrence of condensation. Therefore, in an environment where room temperature varies largely due to on/off of room heating, condensation on the rotating body related to toner image formation can be prevented. Further, without providing a heater dedicated to the photosensitive drum, the photosensitive drum 61 can be continuously warmed so that condensation does not occur. Heating value of the power supply circuit 8 is maintained, and hence the inside temperature can be maintained as when a warm keeping heater is additionally provided. Further, in a period other than the specified period, power consumption of the image forming apparatus can be reduced.

The image forming apparatus (multifunction peripheral 100) includes the operation panel 3 that receives designation of the specified period. Thus, the user can set the specified period. The specified period can be set in accordance with the season. Regardless of being in the Northern Hemisphere or in the Southern Hemisphere, the period for warming the photosensitive drum 61 while room heating is turned off can be arbitrarily set so that no condensation occurs.

The operation panel 3 may receive setting of month and day or month to be the specified period. The user can finely set month and day to be included in the specified period. Further, the user can also set the specified period by unit of month.

In contrast, the image forming apparatus (multifunction peripheral 100) that can use the automatic determination mode includes the printing unit 6, the heater 7, the controller (the main controller 1 and the engine controller 5), the power supply circuit 8, the inside temperature sensor 91, the outside temperature sensor 92, the outside humidity sensor 93, and the storage medium 2. The printing unit 6 includes the photosensitive drum 61 for forming the toner image. The printing unit 6 includes the heating rotating body 66 for heating the paper sheet with the transferred toner image. The heater 7 heats the heating rotating body 66. The controller includes the control circuit 11 and performs controlling. The power supply circuit 8 turns on/off power supply to the printing unit 6, the heater 7, and the controller. The inside temperature sensor 91 detects inside temperature. The outside temperature sensor 92 detects outside temperature. The outside humidity sensor 93 detects outside humidity. The power supply circuit 8 supplies power in one of the first supply mode, the second supply mode, and the third supply mode. In the first supply mode, power is supplied so that printing can be performed by the printing unit 6. More power is supplied in the first supply mode than in the second supply mode or the third supply mode. More power is supplied in the second supply mode than in the third supply mode. The controller recognizes inside temperature on the basis of an output of the inside temperature sensor 91. The controller recognizes outside temperature on the basis of an output of the outside temperature sensor 92. The controller recognizes outside humidity on the basis of an output of the outside humidity sensor 93. On the basis of the recognized inside temperature, outside temperature, and outside humidity, the controller determines whether being in the condensation environment or not. When determining being in the condensation environment, the controller controls the storage medium 2 to store the condensation environment data D2 indicating being in the condensation environment in a nonvolatile manner. In case the condensation environment data D2 is not stored in the storage medium 2, the power supply circuit 8 switches from the power supply in the first supply mode to the power supply in the second supply mode when a predetermined first transition condition is satisfied. When a predetermined second transition condition is satisfied, the power supply circuit 8 switches from the power supply in the second supply mode to the power supply in the third supply mode. In case the condensation environment data D2 is stored in the storage medium 2, the power supply circuit 8 switches from the power supply in the first supply mode to the power supply in the second supply mode when the first transition condition is satisfied. The power supply circuit 8 maintains the second supply mode without performing the switching from the power supply in the second supply mode to the power supply in the third supply mode.

It is possible to determine whether or not being in an environment where condensation occurs due to on/off of room heating. While the condensation environment data D2 is stored (during cold season), decrease in power consumption of the image forming apparatus can be automatically suppressed. It is possible to automatically prevent transfer to the third supply mode. It is possible to intentionally increase power consumption of the image forming apparatus so that condensation does not occur. The type of power supply mode of the power supply circuit 8 can be automatically switched.

More units consume power in the second supply mode than in the third supply mode. While the condensation environment data D2 is stored (during cold season), unless the main power supply is turned off, the power consuming unit in the second supply mode (such as the power supply circuit 8) generates heat so that the rotating body related to toner image formation (such as the photosensitive drum 61) can be warmed. Even when room heating is turned off and room temperature is decreased, temperature of the photosensitive drum 61 can be prevented from decreasing. The photosensitive drum 61 can be prevented from being cooled excessively. The temperature of the photosensitive drum 61 can be maintained so that condensation does not occur when room heating is turned on. When cold season comes, power consumption of the image forming apparatus can be automatically increased so that condensation does not occur. In accordance with whether or not being in the season where condensation occurs due to on/off of room heating, the type of power supply mode of the power supply circuit 8 can be automatically switched.

Further, without providing a heater dedicated to the photosensitive drum, the photosensitive drum 61 can be continuously warmed automatically so that condensation does not occur. When the season where condensation occurs due to on/off of room heating is over, power consumption of the image forming apparatus can be automatically reduced. Further, on the basis of whether or not the condensation environment data D2 (flag indicating being in the condensation environment) is stored, it is possible to check (recognize) whether or not the image forming apparatus is installed in the condensation environment.

The controller determines the moisture amount per unit volume of the outside air on the basis of the outside temperature and the outside humidity. The controller recognizes the saturated water vapor amount at the inside temperature. When the determined moisture amount is larger than the recognized saturated water vapor amount, the controller determines being in the condensation environment. It is possible to accurately determine whether or not being an environment where condensation occurs. There is no misdetermination of condensation despite that condensation does not occur.

Further, the controller recognizes outside temperature every predetermined execution period. The controller checks whether or not the outside temperature has increased by the predetermined threshold value D5 or more during the execution period. When the outside temperature has not increased by the threshold value D5 or more during the execution period for a constant period or longer, the controller determines being not in the condensation environment. When determining being not in the condensation environment, the controller controls the storage medium 2 to delete the condensation environment data D2. When the outside temperature has increased by the threshold value D5 or more during the execution period within the constant period, even when the outside temperature has not increased by the threshold value D5 or more during the execution period, the controller does not control the storage medium 2 to delete the condensation environment data D2. While being in the condensation environment (an environment where condensation occurs), the photosensitive drum 61 and the inside of the image forming apparatus are warmed. Even when the room temperature decreases, the inside temperature does not decrease as much as the room temperature. When determining being in the condensation environment, only by referring to the inside temperature, it is difficult to accurately determine whether or not the current environment is the condensation environment. Therefore, on the basis of variation in the outside temperature, it is also determined whether or not the current environment is the condensation environment. It is possible to accurately determine whether being in the condensation environment or not. When becoming an environment where condensation does not occur due to on/off of room heating (when warm season has come), the restriction against transferring to the third supply mode can be automatically canceled.

In the first supply mode, the power supply circuit 8 performs power supply to the printing unit 6, the heater 7, and the controller. In the first supply mode, the controller controls the heater 7 to maintain the temperature of the heating rotating body 66 at the fixing control temperature. The fixing control temperature is a temperature of the heating rotating body 66 for fixing the toner to the paper sheet. In the second supply mode, the power supply circuit 8 performs power supply to the controller, but stops power supply to the printing unit 6 and the heater 7. In the third supply mode, the power supply circuit 8 stops power supply to the printing unit 6 and the heater 7, and restricts power supply to the controller.

In the specified period, unless the main power supply of the multifunction peripheral 100 is turned off, the power supply circuit 8 and the controller generate heat, thereby the photosensitive drum 61 can be warmed continuously. In a period other than the specified period, power is supplied in the third supply mode so that power consumption of the image forming apparatus can be reduced as much as possible.

The power supply circuit 8 is disposed below the photosensitive drum 61. Heated air tends to rise. In the specified period, the heated air from the power supply circuit 8 can effectively warm the photosensitive drum 61 and the units related to toner image formation.

The controller includes the main controller 1 and the engine controller 5. The engine controller 5 controls action of each member of the printing unit 6 on the basis of an instruction from the main controller 1. The power supply circuit 8 supplies power to the main controller 1 and the engine controller 5 in the first supply mode and in the second supply mode. In the third supply mode, the power supply circuit 8 restricts power supply to the main controller 1. Further, the power supply circuit 8 stops power supply to the engine controller 5. In the third supply mode, power consumption of each controller can be reduced. Power consumption of the image forming apparatus in the third supply mode can be reduced as much as possible.

The main controller 1 includes the communication interface 14 for communication with outside. The power supply circuit 8 supplies power to the communication interface 14 in each of the first supply mode, the second supply mode, and the third supply mode. The power supply circuit 8 supplies power to both the main block 10 and the communication interface 14 of the main controller 1 in the first supply mode and in the second supply mode. In the third supply mode, the power supply circuit 8 stops power supply to the main block 10. When receiving print data, the communication interface 14 requests the power supply circuit 8 to return to the first supply mode. When receiving the request to return to the first supply mode, the power supply circuit 8 performs the power supply in the first supply mode. In the third supply mode, the main controller 1 can limit the power supply only to the communication interface 14 for communication with outside. Power consumption of the image forming apparatus in the third supply mode can be reduced as much as possible. Further, the communication interface 14 operates in every mode, and hence the print instruction (print data) can be received even when power consumption of the image forming apparatus is reduced. When receiving print data, the image forming apparatus can be promptly returned to a state capable of printing.

The photosensitive drum 61 may be a drum having an amorphous silicon photosensitive body. It does not generate condensation, and hence high image quality of the printed matter can be obtained, and a long life image forming apparatus can be provided.

Although the embodiments of the present disclosure are described above, the scope of the present disclosure is not limited to the embodiments, but various modifications can be made within the scope of the disclosure without deviating from the spirit thereof. The present disclosure can be applied to image forming apparatuses having a plurality of modes.

What is claimed is:

1. An image forming apparatus comprising:

a photosensitive drum for forming a toner image;

a heating rotating body for heating a paper sheet with the toner image transferred;

a heater for heating the heating rotating body;

a controller including a control circuit; and a power supply circuit for turning on and off power supply to the heater and the controller, wherein the power supply circuit supplies power in one of a first supply mode, a second supply mode, and a third supply mode, the first supply mode is a mode for supplying power so that printing can be performed, and more power is supplied in the first supply mode than in the second supply mode or the third supply mode, more power is supplied in the second supply mode than in the third supply mode, in a period other than a predetermined specified period, the power supply circuit switches from the power supply in the first supply mode to the power supply in the second supply mode when a predetermined first transition condition is satisfied, while when a predetermined second transition condition is satisfied, the power supply circuit switches from the power supply in the second supply mode to the power supply in the third supply mode, and in the predetermined specified period, the power supply circuit switches from the power supply in the first supply mode to the power supply in the second supply mode when the predetermined first transition condition is satisfied, and maintains the second supply mode without performing the switching from the power supply in the second supply mode to the power supply in the third supply mode.

2. The image forming apparatus according to claim 1, further comprising an operation panel for receiving designation of the predetermined specified period.

3. The image forming apparatus according to claim 2, wherein the operation panel receives designation of month and day or month to be the predetermined specified period.

4. The image forming apparatus according to claim 1, wherein the power supply circuit performs power supply to the heater and the controller in the first supply mode, the controller controls the heater to maintain temperature of the heating rotating body at a fixing control temperature in the first supply mode, the fixing control temperature is temperature of the heating rotating body for fixing toner to the paper sheet, the power supply circuit performs power supply to the controller but stops power supply to the heater in the second supply mode, and the power supply circuit stops power supply to the heater and restricts power supply to the controller in the third supply mode.

5. The image forming apparatus according to claim 1, wherein the power supply circuit is disposed below the photosensitive drum.

6. The image forming apparatus according to claim 1, wherein the controller includes a main controller and an engine controller, the engine controller controls printing on the basis of an instruction from the main controller, and the power supply circuit supplies power to the main controller and the engine controller in the first supply mode and in the second supply mode, while in the third supply mode the power supply circuit restricts power supply to the main controller and stops power supply to the engine controller.

7. The image forming apparatus according to claim 6, wherein the main controller includes a communication interface for communication with outside, the power supply circuit supplies power to the communication interface in each of the first supply mode, the second supply mode, and the third supply mode, the power supply circuit supplies power to both a main block and the communication interface of the main controller in the first supply mode and in the second supply mode, the power supply circuit stops power supply to the main block in the third supply mode, the communication interface requests the power supply circuit to return to the first supply mode when receiving print data, and the power supply circuit performs the power supply in the first supply mode when receiving the request to return to the first supply mode.

8. The image forming apparatus according to claim 1, wherein the photosensitive drum has an amorphous silicon photosensitive body.

9. An image forming apparatus comprising:

a photosensitive drum for forming a toner image;

a heating rotating body for heating a paper sheet with the toner image transferred;

a heater for heating the heating rotating body;

a controller including a control circuit;

a power supply circuit for turning on and off power supply to the heater and the controller;

an inside temperature sensor for detecting inside temperature;

an outside temperature sensor for detecting outside temperature;

an outside humidity sensor for detecting outside humidity; and a storage medium, wherein the power supply circuit supplies power in one of a first supply mode, a second supply mode, and a third supply mode, the first supply mode is a mode for supplying power so that printing can be performed, and more power is supplied in the first supply mode than in the second supply mode or the third supply mode, more power is supplied in the second supply mode than in the third supply mode, the controller recognizes the inside temperature on the basis of an output of the inside temperature sensor, recognizes the outside temperature on the basis of an output of the outside temperature sensor, recognizes the outside humidity on the basis of an output of the outside humidity sensor, and determines whether being in a condensation environment or not on the basis of the recognized inside temperature, outside temperature, and outside humidity, when determining being in the condensation environment, the controller controls the storage medium to store condensation environment data indicating being in the condensation environment in a nonvolatile manner, in case the condensation environment data is not stored in the storage medium, the power supply circuit switches from the power supply in the first supply mode to the power supply in the second supply mode when a predetermined first transition condition is satisfied, and switches from the power supply in the second supply mode to the power supply in the third supply mode when a predetermined second transition condition is satisfied, and in case the condensation environment data is stored in the storage medium, the power supply circuit switches from the power supply in the first supply mode to the power supply in the second supply mode when the predetermined first transition condition is satisfied, and maintains the second supply mode without performing the switching from the power supply in the second supply mode to the power supply in the third supply mode.

10. The image forming apparatus according to claim 9, wherein the controller determines moisture amount per unit volume of outside air on the basis of the outside temperature and the outside humidity, recognizes saturated water vapor amount at the inside temperature, and when the determined moisture amount is larger than the recognized saturated water vapor amount, the controller determines being in the condensation environment.

11. The image forming apparatus according to claim 9, wherein the controller recognizes the outside temperature every predetermined execution period, checks whether or not the outside temperature has increased by a predetermined threshold value or more during the execution period, when the outside temperature has not increased by the threshold value or more during the execution period for a constant period or longer, the controller determines being not in the condensation environment, when determining being not in the condensation environment, the controller controls the storage medium to delete the condensation environment data, when the outside temperature has increased by the threshold value or more during the execution period within the constant period, even when the outside temperature has not increased by the threshold value or more during the execution period, the controller does not control the storage medium to delete the condensation environment data.

12. The image forming apparatus according to claim 9, wherein the power supply circuit performs power supply to the heater and the controller in the first supply mode, the controller controls the heater to maintain temperature of the heating rotating body at a fixing control temperature in the first supply mode, the fixing control temperature is temperature of the heating rotating body for fixing toner to the paper sheet, the power supply circuit performs power supply to the controller but stops power supply to the heater in the second supply mode, and the power supply circuit stops power supply to the heater and restricts power supply to the controller in the third supply mode.

13. The image forming apparatus according to claim 9, wherein the power supply circuit is disposed below the photosensitive drum.

14. The image forming apparatus according to claim 9, wherein the controller includes a main controller and an engine controller, the engine controller controls printing on the basis of an instruction from the main controller, and the power supply circuit supplies power to the main controller and the engine controller in the first supply mode and in the second supply mode, while in the third supply mode the power supply circuit restricts power supply to the main controller and stops power supply to the engine controller.

15. The image forming apparatus according to claim 14, wherein the main controller includes a communication interface for communication with outside, the power supply circuit supplies power to the communication interface in each of the first supply mode, the second supply mode, and the third supply mode, the power supply circuit supplies power to a main block as a part other than the communication interface of the main controller in the first supply mode and in the second supply mode, the power supply circuit stops power supply to the main block in the third supply mode, the communication interface requests the power supply circuit to return to the first supply mode when receiving print data, and the power supply circuit performs the power supply in the first supply mode when receiving the request to return to the first supply mode.

16. The image forming apparatus according to claim 9, wherein the photosensitive drum has an amorphous silicon photosensitive body.

17. A method for controlling an image forming apparatus, comprising:

forming a toner image using a photosensitive drum;

heating a paper sheet with the toner image transferred using a heating rotating body;

heating the heating rotating body using a heater;

configuring a controller to include control circuit;

turning on and off power supply to the heater and the controller;

supplying power in one of a first supply mode, a second supply mode, and a third supply mode;

configuring the first supply mode as a mode for supplying power so that printing can be performed, and that more power is supplied in the first supply mode than in the second supply mode or the third supply mode;

configuring so that more power is supplied in the second supply mode than in the third supply mode;

in a period other than a predetermined specified period, switching from the power supply in the first supply mode to the power supply in the second supply mode when a predetermined first transition condition is satisfied, while switching from the power supply in the second supply mode to the power supply in the third supply mode when a predetermined second transition condition is satisfied; and in the predetermined specified period, switching from the power supply in the first supply mode to the power supply in the second supply mode when the predetermined first transition condition is satisfied, and maintaining the second supply mode without performing the switching from the power supply in the second supply mode to the power supply in the third supply mode.

* * * * *